US010619317B2

(12) United States Patent
Waters, Jr.

(10) Patent No.: US 10,619,317 B2
(45) Date of Patent: Apr. 14, 2020

(54) FLOOD BARRIER

(71) Applicant: Louis A. Waters, Jr., Bellaire, TX (US)

(72) Inventor: Louis A. Waters, Jr., Bellaire, TX (US)

(73) Assignee: Floodbreak, L.L.C., Bellaire, TX (US)

( * ) Notice: Subject to any disclaimer, the term of this patent is extended or adjusted under 35 U.S.C. 154(b) by 0 days.

(21) Appl. No.: 16/241,889

(22) Filed: Jan. 7, 2019

(65) Prior Publication Data

US 2019/0211521 A1 Jul. 11, 2019

Related U.S. Application Data

(60) Provisional application No. 62/614,860, filed on Jan. 8, 2018.

(51) Int. Cl.
*E02B 3/10* (2006.01)

(52) U.S. Cl.
CPC ..... *E02B 3/102* (2013.01)

(58) Field of Classification Search
CPC combination set(s) only.
See application file for complete search history.

(56) References Cited

U.S. PATENT DOCUMENTS 8,714,875 B2 * 5/2014 Morii ..... E02B 7/50 210/170.1
10,036,133 B2 7/2018 Adler
2003/0053864 A1 * 3/2003 Rijlaarsdam ..... E02B 3/102 405/107
2003/0156903 A1 * 8/2003 Wiseman ..... E02B 3/106 405/115
2013/0094905 A1 4/2013 Schnaars, et al.
2014/0369754 A1 12/2014 Waters, Jr.
2016/0010298 A1 1/2016 Waters, Jr.
2016/0244927 A1 8/2016 Adler

FOREIGN PATENT DOCUMENTS

EP 2915923 A1 9/2015

OTHER PUBLICATIONS

International Search Report and Written Opinion of ISA and Search Strategy.

* cited by examiner

*Primary Examiner* — Kyle Armstrong
(74) *Attorney, Agent, or Firm* — Tim L. Burgess P.C.

(57) ABSTRACT

Flood barrier assemblies in land near a water frontage shoreline have next adjacent panels actively erectable into a continuous barrier preventing flooding of the land. In one configuration one lateral side of a panel is a contact surface and the other lateral side carries a gasket. The panels are sequentially raised with a first to raise panel presenting a contact surface to the gasket of the next adjacent second to raise panel. In another configuration, a contact surface is on opposing lateral sides of two panels separated by a next adjacent panel between them having gaskets on both its lateral sides. The spaced first panels raise before the second panel. The raised panels may be in a linear or curved array or a combination of linear and curved arrays. Either configuration and order of raising erects a flood barrier wall sealed panel to panel by the gasket between adjacent panels.

34 Claims, 29 Drawing Sheets

FLOOD BARRIER

CROSS REFERENCE TO RELATED APPLICATION

This application claims the benefit of U.S. Provisional Application 62/614,860 filed Jan. 8, 2018.

BACKGROUND OF THE DISCLOSURE

1. Field of the Disclosure

This invention relates to flood barriers to prevent flooding of land and improvements on the land by water rising from an adjacent body of water.

2. Background

New York City was built right to the water's edge. It is a coastal city surrounded by water on all sides. With 578 miles of coastal water front, all that water front is New York City's greatest threat. This was especially evident when tropical storm Sandy, on Oct. 29 and 30, 2012, struck New York City, its suburbs, and Long Island, catching the City by surprise. Supplemented by a high tide, the storm surge was approximately 14 feet above mean low tide, overtopping seawalls and bulkheads lining Manhattan and other waterfront boroughs, flooding buildings, subway and vehicle tunnels, damaging electrical equipment, costing at least 48 lives, and in effect shutting down the City. The City was flooded by 1.2 billion gallons of water including raw and partially treated sewage. The storm surge engulfed the city with 700,000 tons of debris. It was the worst natural disaster in the City's history. Damages and economic losses across New York City were estimated to be at least $33 billion.

Climate change will continue to raise sea levels throughout the century and storms are going to be more intense. NYC lies in a hurricane zone and chances of other major storms are significant. Inevitably, sea water is coming its way.

Sandy flooded 51 square miles, 17% of the City. With sea levels projected to rise by six feet by the turn of the century, that six more feet of water would cover 100 square miles or ⅓ of the City and make parts of the City uninhabitable. The City is a center of banking, finance, technology, arts and the media; it has more Fortune 500 companies than anywhere else on the planet. What happens to the City has a global impact. New York City is not alone in this threat of inundation. Major coastal metropolitan areas such a Miami, Fla.; London, England; and Tokyo, Japan are also at high risk due to rising sea levels and at least for Miami, also hurricanes, and for Tokyo, also typhoons.

Coastal defense solutions, such as the "Big-U" proposed for New York City, urge a permanent erection of fabricated steel or concrete high walls or levees alongside seawalls or bulkheads to hold back storm surge or other rising floodwaters, but such erections permanently block a desired ground level view of the surrounding waterscape, may hinder access to the body of water, and are opposed by many citizens. Even so, surface and elevated streets and buildings alongside seawalls or bulkheads may leave inadequate horizontal or vertical space available for permanent fixed walls or levees, at least in part due to zero-line streets and buildings constructed alongside bulkheads and seawalls. Even where there is no zero-line construction, there may be no space to put a levee, which typically needs to be twice as wide as tall. Further, a permanent wall and other fortress-style defenses surrounding the City may leave a walled city feeling shut in, more like a prison than a home.

Solutions that do not permanently block the view of the waterscape of a body of water lined by the bulkhead, seawall, levee, dike or other shoreline water barrier construction have been proposed in the past. U.S. Pat. No. 9,279,224 by the inventor of the present invention describes a passive self erecting system involving buoyant panels rotating upward between flanking permanent end walls to form a floodwater barrier but this works only if water is already coming ashore to lift the panels and is not actively erectable in advance on threat of a storm. U.S. Pat. No. 9,458,588 also by the inventor of the present invention describes a system for actively lifting buoyant panels, but the panels do not interact as do those in the instant invention.

U.S. Pat. No. 4,377,352 describes a passive water containment barrier lining a riverbank using flexible sheeting between buoyant stanchions. U.S. Pat. Nos. 6,338,594 and 6,514,011 describes elevating buoyant walls from an underground chamber into which water is pumped to float the walls vertically upwardly. U.S. Pat. Nos. 5,725,326 and 7,744,310 describe use of rising storm waters to fill underground chambers and buoy walls vertically upwardly atop a dike or bulkhead. U.S. Pat. No. 7,033,112 describes using a folded metal wall situated in an accommodation space in a dike that can be unfolded and locked in place by workers. U.S. patent publication 2007/0189854 describes manual erection of counterbalanced slabs for flood defense with gaps between slabs filled by boards inserted in channels on sides of the slabs. U.S. patent publication 2017/0175352 describes a boardwalk of boards running parallel to the shoreline with dual use as a flood control barrier erectable by a motor acting on a geared hinge shaft to which a shore-most plank is attached. All these latter solutions have structural and other engineering limitations that make them inapplicable to land surface level defenses to protect against inundation of vast areas of an entire city.

The invention described herein is at the least a partial solution and for some locations a complete solution for at-risk cities when flooding water inevitably comes ashore.

BRIEF DESCRIPTION OF THE DRAWINGS

In the following detailed description of exemplary embodiments, reference is made in some embodiments to the accompanying drawings, which form a part hereof and in which are shown by way of illustration non-limiting embodiments by which the invention may be practiced. In the drawings and descriptions, like or corresponding parts are marked throughout the specification and drawings with the same reference numerals or a variation of that number. For example, gasket 52 is sometimes referenced more particularly as 52*a* or 52*b* for a particular type of gasket, and contact surface 56 is also sometimes more particularly referenced as 56*a* (a contact surface that is parallel to a top surface), 56*b* (a contact surface perpendicular to a top surface) or 56*c* (a contact surface that is perpendicular to and angled acutely to a top surface). Mention of such numbers as 52 or 56 are not exclusive but are to be understood as inclusive of the variations of such numbers. Certain features of the invention are shown in exaggerated scale or in somewhat schematic form and in some drawing some details of elements shown in other drawings are omitted in the interest of clarity and conciseness. Referring to the drawings:

FIG. 1 is an isometric perspective view of an exemplary embodiment of a flood barrier series of panels in which the exemplary embodiments of FIGS. 2-5 may be located.

FIG. 2 is a schematic perspective view shows a raised first panel of a pair of panels with the second of the pair sequentially rising and approaching the first panel.

FIG. 3 is a close up schematic perspective from the same view as FIG. 2 showing the second panel getting closer to full rise than in FIG. 2 with a gasket on the second panel contacting a contacting surface of the first panel.

FIG. 4 is a schematic perspective from a different angle than FIGS. 2 and 3 showing the second panel in full rise sealing the gap between the first and second panels.

FIG. 5 is a schematic showing an end view of the sealing engagement of the first and second panels.

FIG. 6 is an isometric schematic view from the dry side of an embodiment of a flood barrier showing a series of contiguous panels linearly arranged side by side and substantially horizontally disposed relative to surface of land (as depicted, land under an overhead structure such as an elevated freeway) and flush with the surface of the land, resident in a lowered position within a support pan, and also depicts upright structures, in this instance a freeway upright support pillar fixed to land adjacent each end panel of the contiguous units.

FIG. 7 is the view of FIG. 6 showing a contiguous far group of panels raised.

FIG. 8 is the view of FIG. 7 showing a contiguous near group of panels being raised all at the same time.

FIG. 9 is a view in the same perspective as FIGS. 6-8 showing all the far and near contiguous groups of panels raised.

FIG. 10 is a perspective view of an exemplary embodiment of a flood barrier series of panels better showing a panel raising mechanism than in FIG. 1. The view of both FIG. 1 and FIG. 10 is from the wet side of the barrier when the panels are raised to block invading water.

FIG. 11 isometrically depicts the embodiment of FIG. 10 in which the top surface of each panel is substantially horizontally disposed relative to surface of land and resident in a lowered position within a support pan, and also depicts an upright structure, in this instance a wall, adjacent each end panel.

FIG. 12 isometrically depicts the embodiment of FIG. 11 rotated to the viewer slightly clockwise with one wall resected to reveal more of the end panel nearest it.

In FIGS. 13-18 the panel raising mechanism shown in FIGS. 1 and 10 is removed to afford a better view of the interior of the support pan, but it is to be understood that the panel raising mechanism is present as in FIG. 10.

FIG. 13 is the embodiment of FIG. 10 at the same rotation to the viewer as FIG. 12 but with the resected wall of FIG. 12 removed for a better view of the interior of the support pan. In FIG. 13, the end panel nearest the removed wall is raised, the center panel remains lowered and the end panel adjacent the far wall is being raised.

FIG. 14 is the embodiment of FIG. 13 with the end panel adjacent the far wall raised.

FIG. 15 is the embodiment of FIG. 14 as seen from the dry side of the barrier with the two end panels raised and in this instance with the center panel being raised.

FIG. 16 is the embodiment of FIG. 15 as seen from the wet side of the barrier with the two end panels raised and the center panel being raised.

FIGS. 17 and 18 depict a sequence in which the end panel near the resected wall in FIG. 13 is raised, then while the other end panel is being raised, the center panel begins raising.

FIG. 19 is an isometric view of the front ends of adjacent panels of the embodiments of FIGS. 13-18 showing the approaching sealing closure of the center panel carrying compression seals on its lateral sides against the next adjacent lateral side contact surface of the end panel that is the end panel next to the wall resected in FIG. 17.

FIG. 20 is a top plan view of the approaching sealing closure of the center panel against the two end panels.

FIG. 21 is partial top plan view showing the compression seal closure of the lateral side of the center panel against the contact surface of the next adjacent end panel that is next to the same wall as resected in FIG. 17.

FIG. 22 is a partial top plan view showing the wiper seal closure of the end panel next to the unresected end wall of FIG. 18.

FIG. 23 is a wet side isometric view of the apparatus of FIGS. 10-18 showing all panels in raised upright position and showing the panel raising mechanism in place, as in FIG. 10.

FIG. 24 is a side see-through perspective view of four housed nested panels arranged in an inside curve to go along an inwardly curving shoreline. The center of the inside curve is to the right of the viewer on the wet side of the flood barrier. The see-though view allows one to see panels overlaid by overlapping panels in a horizontal position.

FIG. 25 is a top plan see-through view of the nested panels of FIG. 24.

FIG. 26 is a top plan view of the panels of FIG. 25 fully raised.

FIG. 27 is an isometric view of the panels of FIGS. 24-26 fully raised, viewed from the left end wet side of the flood barrier.

FIG. 28 is an isometric view of the panels of FIG. 28 fully raised, partially viewed from the left end dry side of the flood barrier.

FIG. 29 is an isometric view of the panels of FIG. 28 fully raised, viewed from the right end wet side of the flood barrier.

FIG. 30 is a side perspective view of four housed panels arranged in an outside curve to go around an outside corner or point of a shoreline. The center of the curve is to the left of the viewer on the dry side of the flood barrier.

FIG. 31 a top plan view of the housed panels of FIG. 30.

FIG. 32 is a top plan view of the raised panels housed in FIG. 30, showing the splayed spread of the housings as also seen on FIG. 31 for going around an outside corner or point of a shoreline.

FIG. 33 is an isometric view of the raised panels of FIG. 32, viewed from an intermediate wet side of the flood barrier.

FIG. 34 is an isometric view of the raised panels of FIG. 32, viewed from the left end wet side of the flood barrier.

FIG. 35 is an isometric view of the raised panels of FIG. 32, viewed from the right end wet side of the flood barrier.

FIG. 36 is a partial perspective view showing the wiper seal closure of adjacent end panels of the panels of FIGS. 32-35.

FIG. 37 is an isometric view of the raised panels of FIG. 36, viewed from the intermediate dry side of the flood barrier.

DETAILED DESCRIPTION OF EMBODIMENTS

Figure 1:
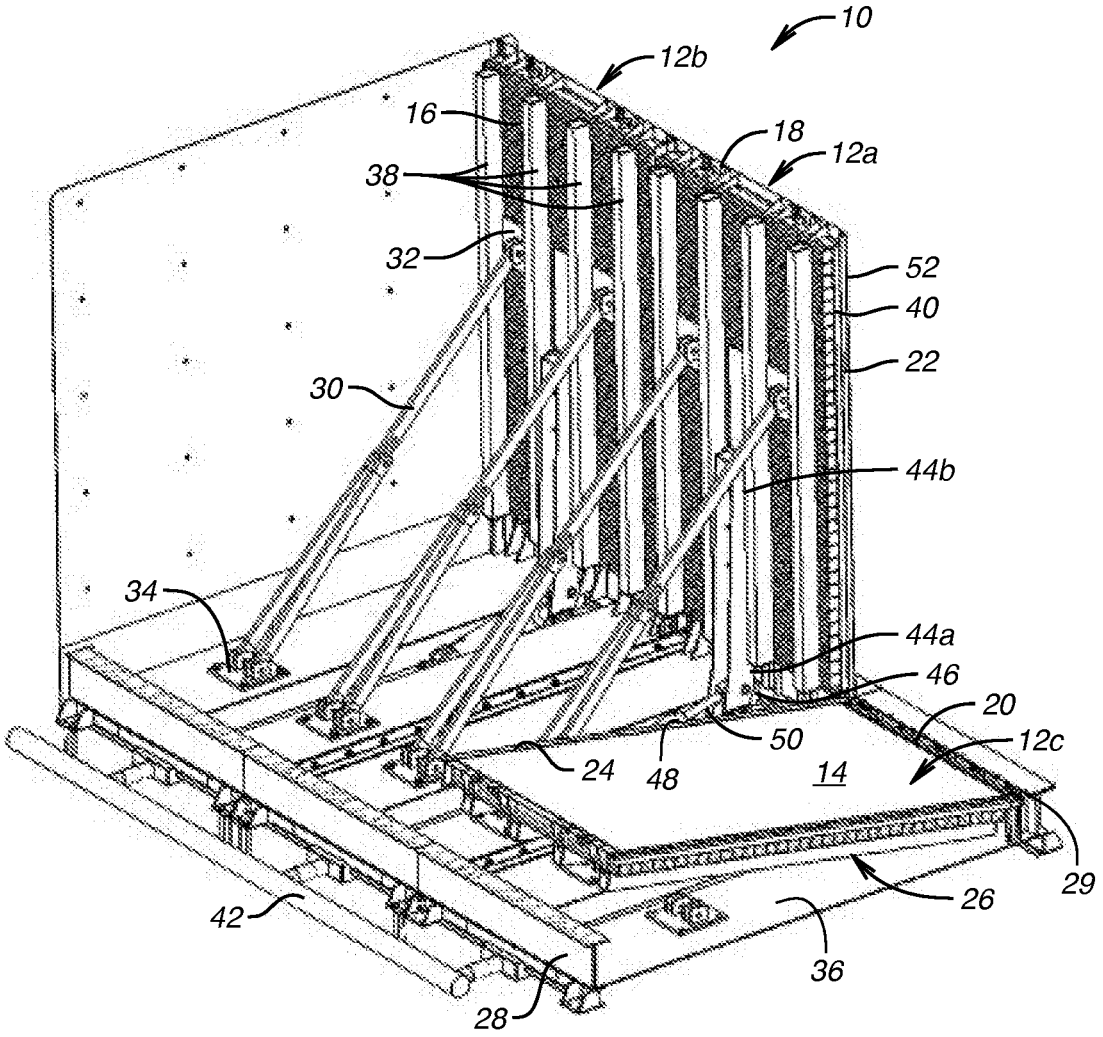
FIGS. 1-23 depict a linear arrangement of exemplary embodiments of a flood barrier series of panels in accordance with this invention.
Figure 2:
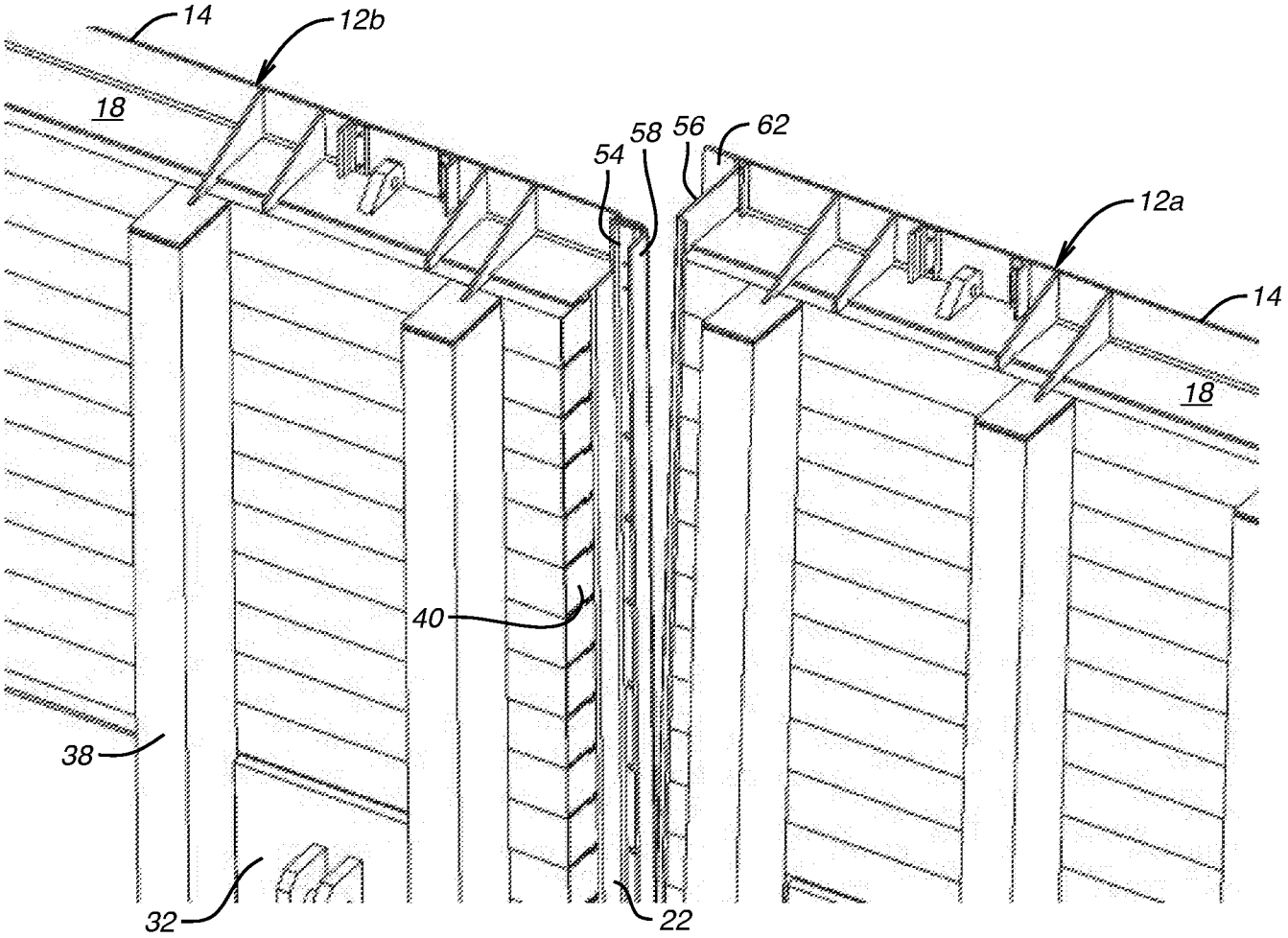

In accordance with this invention, a series of next adjacent flood barrier panels are arranged on land near a water frontage shoreline, providing a surface not interfering with a view of the water but mechanically erectable on notice of an impending potentially flooding storm to provide a continuous vertical barrier that can stretch for miles, preventing flooding of land on the dry side of the barrier, thus eliminating a need for fabricated steel or concrete high walls or levees to hold back storm surge or other rising floodwaters. The manner of arranging and erecting the series of flood barrier panels on land near a water frontage shoreline allows the flood barrier panels to follow a shoreline linearly and along curves and up and down slopes and inclines.

Specific details described herein, including what is stated in the Abstract, are in every case a non-limiting description and exemplification of embodiments representing concrete ways in which the concepts of the invention may be practiced. This serves to teach one skilled in the art to employ the present invention in virtually any appropriately detailed system, structure or manner consistent with those concepts. Reference throughout this specification to "an exemplary embodiment" means that a particular feature, structure, or characteristic described in connection with the embodiment is included in at least one exemplary embodiment of the present invention. Thus, the appearances of the phrase "in an exemplary embodiment" or similar expression in various places throughout this specification are not necessarily all referring to the same embodiment. Further, the particular features, structures, or characteristics may be combined in any suitable manner in one or more embodiments. Various changes and alternatives to the specific described embodiments and the details of those embodiments may be made within the scope of the invention. One or more of the elements depicted in the drawings can also be implemented in a more separated or integrated manner, or even removed or rendered as inoperable in certain cases, as is useful in accordance with a particular application. Because many varying and different embodiments may be made within the scope of the inventive concepts herein described and in the exemplary embodiments herein detailed, it is to be understood that the details herein are to be interpreted as illustrative and not as limiting the invention to that which is illustrated and described herein.

The various directions such as "upper," "lower," "back," "front," "perpendicular," "normal," "vertical", "upright", "horizontal," "length," "laterally", "proximal", "distal" and so forth used in the detailed description of exemplary embodiments are made only for easier explanation in conjunction with the drawings. The components may be oriented differently while performing the same function and accomplishing the same result as the exemplary embodiments herein detailed embody the concepts of the invention, and such terminologies are not to be understood as limiting the concepts which the embodiments exemplify. The terms "horizontal" or "horizontally" include but are not limited to literal horizontal and generally mean not out of level with respect to immediately adjacent land to a degree that will materially adversely affect the function of the element described as horizontal. Similarly, the terms "vertical" or "upright" include but are not limited to literal vertical and generally mean substantially up and down with respect to immediately adjacent land to a degree that will not materially adversely affect the function of the element described as vertical or upright.

As used herein, the terms "comprises," "comprising," "includes," "including," "has," "having" or any other variation thereof, are intended to cover a non-exclusive inclusion. For example, apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. That is, unless otherwise indicated, the term "or" is generally intended to mean "and/or". For example, a condition A or B is satisfied by any one of the following: A is true (or present) and B is false (or not present), A is false (or not present) and B is true (or present), and both A and B are true (or present).

As used herein, the use of the word "a" or "an" when used in conjunction with the term "comprising" (or the synonymous "having" or "including") in the claims and/or the specification may mean "one," but it is also consistent with the meaning of "one or more," "at least one," and "one or more than one." In addition, as used herein, the phrase "connection to" or "connected to" means joined to, either directly or through intermediate components.

Exemplary apparatus embodiments of the invention comprise a plurality of flood barrier assemblies arranged in or on land near a water frontage shoreline. Each assembly comprises at least one support pan situated in or on land near a water frontage shoreline. Each assembly further comprises a plurality of next adjacent panels, each panel having a top surface, a bottom surface, a front end, a back end, and lateral sides. Imagined projections of the lateral sides intersect the shoreline at an angle, i.e., the lateral sides are not parallel to the shoreline. The lateral sides have a length that runs from the back end to at least near the front end of the panel. The lateral sides may be perpendicular to the top surface of the panel. The lengths of the lateral sides may or may not be equal. A panel may be four-sided and opposing sides may be but need not be symmetrical. The panels reside in the support pans in a lowered position and are hingedly rotatable on a substantially horizontal first axis of rotation at the back end of the panel to rotate upwardly from the pan to an upright raised position where invading flood water will be contained at and behind the bottom surface of the panel.

The support pan may be on the surface of the land in a non-traffic area near the shoreline, that is, it may be surface mounted to the land, or in a trafficked area near the shoreline, the support pan may be installed in the land, that is, in an excavation. In an exemplary embodiment in which the support pan is installed in the land, the top surface of each panel may be substantially horizontally disposed relative to the surface of land when the panel is in a lowered position in the support pan. In such disposition, the panels resident in the support pan may present an over-trafficking surface for use by pedestrians or vehicles or both in normal times when a flooding storm is not threatened.

By "substantially" when saying the top surface of each panel may be substantially horizontally disposed is meant an accommodation to terrain. The surface of the land may be level with the horizon or may be sloped. If the surface of the land is level, the top surface of a panel may be substantially horizontally levelly disposed and may even be substantially flush with the surface of the land in which the support pan is situated. If the surface of the land is sloped, a portion of the slope may be excavated along the length of the slope (not the incline of the slope) to present a substantially horizontal surface in which the pan may be embedded so that the top surface of the panel in the pan is substantially horizontally disposed with the horizon albeit not with the slope. Or the pan may be embedded at an angle of the incline of the slope and risers may be placed in the down-sloped locations in the pan to elevate the surface of the panel at the front end of the panel in the pan to a substantially horizontal position, the hinged first axis of rotation being up-slope in the pan. Or the top surface of the pan may be angled relative to the bottom surface so the top surface will be substantially horizontal to the horizon although the bottom surface would not be.

The plurality of next adjacent panels may climb or descend a hill, taller panels at the bottom of the hill, ever less tall panels proceeding to the top of the hill, the top surface of the panels providing ever narrowing substantially horizontal pedestrian steps up the hill and ever widening substantially horizontal pedestrian steps down the hill.

The support pan may be embedded in the slope at an angle and accommodations made in a panel raising mechanism to swing the panels through more than a 90 degree arc; in such instance, with such accommodations, the top surface of the panel may or may not be sufficiently substantially horizontal to provide an over-trafficking surface.

The plurality of next adjacent panels have either (i) a "first configuration" in which one panel has (a) a gasket attached to a panel lateral side that is next adjacent to another panel, the gasket coursing the length of the panel lateral side and (b) a contact surface on the other lateral side of the one panel than the lateral side to which the gasket is attached, the contact side running the length of such other lateral side, or (ii) a "second configuration" in which a first panel separates two panels next adjacent to the first panel, the two panels each having a contact surface on at least one lateral side next adjacent the first panel, such contact surface running the length of such lateral side, and in which the first panel has a gasket attached on each of its lateral sides, such gasket running the length of the lateral side to which it is attached, or (iii) a "third configuration" comprising a combination of one or more panels of the first configuration and one or more panels of the second configuration. These configurations provide an edge seal to next adjacent panels, preventing water impounded behind the bottom surface of the panels from passing through the next adjacent panels.

In an exemplary embodiment an upright structure is fixed to land adjacent each end of a series of next adjacent panels providing the flood barrier. The upright structure has a contact surface as tall as the panel next adjacent to the upright structure when such next adjacent panel is in the upright position. The lateral side of the panel next adjacent the upright structure attaches a gasket for sealing contact with the contact surface of the upright structure.

In an exemplary embodiment at least one tensioning member is connected to the support pan and to the bottom surface of each panel. When loaded by hydrostatic pressure of water impounded on the bottom side of raised panels, the tensioning members prevent the panels from rotating past an upright position. This arrangement—with the water contained at the backside of the panels and with hydrostatic pressure pressing the gaskets against the contact surfaces and loading the tensioning members—offers superior leakage resistance and panel strain protection from the force of the impounded water. Importantly also, the tensioning members allow long runs of next adjacent panels without need of intermediate support posts.

In an exemplary embodiment the contact surface at the lateral side of a panel may comprise an extension from the top surface of the panel over the lateral side substantially coplanar to the top surface, or the contact surface at the lateral side of a panel may comprise a lateral projection from the lateral side substantially parallel to the top surface. In such an embodiment the gasket may be a compression seal.

In an exemplary embodiment the contact surface at the lateral side of a panel may be the lateral side itself. In such an embodiment, the gasket may be a wiping seal having a front wiping side and a pressure application back side.

In an exemplary embodiment, the panels of the assembly are sequentially raiseable from the support pan to an upright position, either (i) as individual panels in a predetermined sequence, or (ii) as contiguous groups of panels in which adjacent panels of a first contiguous group are raised all at the same time followed by adjacent panels of a second contiguous group raised all at the same time, and so on for the number of groups. In either instance of (i) or (ii), at least one panel or a group of panels is raised before a next adjacent panel or an next adjacent group of panels is raised, the first raised at least one panel or first raised group of panels presenting a contact surface for contact of the gasket of the second to rise next adjacent panel or the next adjacent panel of said second to rise group of panels. Hydrostatic pressure from water blocked at the bottom surface presses the gasket of the second to rise panel or second group of panels against the contact surface of the first to rise panel or of the second to rise second group of panels, providing a positive seal against invading flood water passing between the raised panels.

In an exemplary embodiment, the predetermined sequence for panels in the above mentioned "first configuration" is raising individual panels or a group of panels successively one after the other.

In another exemplary embodiment, the predetermined sequence for panels in the above mentioned "second configuration" is raising the two separated panels having a contact surface on at least one lateral side before raising the first panel having a gasket attached on both lateral sides.

The panels may be arrayed linearly, for example in a generally straight line (see, e.g., FIGS. 1-23) or even a linear zigzag line. In a linear array of panels the panels may be raiseable from the support pan to an upright position all at the same time or sequentially in a predetermined sequence as mentioned above. In an exemplary embodiment, when the panels are linearly arrayed in a generally straight line, the contact surface on the lateral side of a panel may extend past the lateral side of the panel, for example, as an extension of the top surface over the lateral side substantially coplanar to the top surface, or as a lateral projection from the lateral side that is substantially parallel to the top surface. Such an arrangement may use a compression seal gasket. In another exemplary embodiment when the panels are linearly arrayed in a generally straight line or when panels are arranged in an outside curve (described below), the contact surface at the lateral side of a panel may be the lateral side itself, and in such instance the gasket may be a wiping seal having a front wiping side and a pressure application back side.

In an exemplary embodiment, the panels may be linearly arrayed in a zigzag arrangement, that is, in a line or course having alternate right and left turns, for example to follow an undulating shoreline as a series of inside and outside curves (about curves, see more below). In a zigzag with the "zig" to the viewer's left when looking down at the zigzag line, the contact surface on the lateral side of the zig panel may be acutely angled to the top surface of that panel as when the panels are arrayed in an inside curve (described below). The contact surface of a "zag" panel could be angled obtusely to the top surface, as when that panel would traverse an outside curve.

In an exemplary embodiment in a linear arrangement, when the panels of a group of panels to be raised as a unit are resident in a support pan, single or plural interior panels (i.e., panels not at the end of the array) each may have a gasket already contacting the contact surface of the next adjacent panel.

Panels at the end of the array (terminal panels at the ends of a plurality of panel units) may have lateral sides fitted with gaskets. An upright structure fixed to land adjacent each end of a series of panels and at least as tall as the end panel in the upright position will have a contact surface as tall as the end panels in their upright position, for sealing contact of the gaskets with the contact surface of the upright structure. An example of such an upright structure is a pillar as shown in FIGS. 6-9 or a wall as shown in FIGS. 1, 10-18, 20, 22 and 23.

The panels of the assembly when raised and upright also may be arrayed in a curve, to curve around an outside corner of a shore line where a linear shoreline turns inland, or to curve around the inside corner of a shoreline where the inland shoreline bends inward. Herein a curve for an outside corner of a shoreline is called an "outside curve," and a curve for an inside corner of a shore line is called an "inside curve." Panels arrayed in an outside curve are advantageous for protecting land on the interior of the curve by blocking water on the exterior of the curve (see, e.g. FIGS. 30-37). Panels of the assembly embodiments exemplified herein that are arrayed in an inside curve (see. e.g. FIGS. 24-29) are advantageous for protecting land on the exterior of the curve by blocking water on the interior of the curve. In an exemplary embodiment in which panels are arrayed in an inside curve, the contact surface on the lateral side of a panel may be acutely angled to the top surface of the panel.

Ability to arrange the raised and upright panels continuously and sealingly both linearly and in a curve allows the panels to continuously sealingly follow a shoreline. For example, the shoreline may be linear for some length advantageously sealed by panels in a linear arrangement (e.g., see FIGS. 1-23) and the shoreline may then bend inwardly into the land about an outside corner of the land. The panels can then transition from a linear arrangement into an outside curve arrangement to follow the outside corner of the shoreline, keeping the water on the exterior of the curve and the land on the dry interior side (e.g. FIGS. 30-37). The shoreline may then resume a linear stretch and the panels can re-transition to a continuously sealing linear arrangement (e.g., FIGS. 1-23) for that stretch of shoreline, and then as the water reaches the extent of its inland excursion with the shoreline turning inwardly again, the panels may transition into one or more inside curves (e.g. FIGS. 24-29), keeping the dry side of the land on the exterior of the curve and the wet side on the interior of the curve, and then may continuously sealingly connect the panels along another linear stretch (e.g. FIGS. 1-23) as the inlet turns back to the main body of water, the panels than connecting in an outside curve (e.g. FIGS. 30-37) as the shoreline turns an outside corner, keeping the water side on the exterior of the curve, followed by another linearly connected run of panels as the shoreline resumes in a linear stretch, and so forth. In another example, ability to arrange the panels continuously and sealingly in an outside curve (e.g. FIGS. 30-37) allows the panels to continuously and sealingly curve around a point of land surrounded by water, keeping the water side on the exterior of the curve and the dry land side on the interior of the curve.

The contact surface on a lateral side of a panel may be a flat surface. In an exemplary embodiment of sequential erection of panels or groups of panels in a linear array, the contact surface of the first to rise panel or group of panels may extend laterally from the lateral side of a panel parallel to the top surface and the gasket of the second to rise panel or second to rise group of panels may be a compression gasket that presses against the contact surface extending from the lateral side of the first panel.

In another exemplary embodiment, the contact surface is the lateral side of a panel and the gasket is a wiping seal having a front wiping side and a pressure application back side. In the "first configuration" mentioned above the contact surface is on one lateral side of the panel (each panel has a flat contact surface mounted on the other lateral side of such panel than the lateral side to which the gasket is attached). On sequential rise of panels or a group of panel, either in a linear array or in a curve array, the front wiping side of the gasket of a second to rise panel or group of panels wipes the contact surface of the next adjacent first to rise panel or group of panels with the pressure application back side of the gasket pressing the front wiping side against the contact surface of the next adjacent first to rise panel or group of panels. In an embodiment of the "second configuration" mentioned above, in which the contact surface is on both lateral sides of a first to rise spaced apart panels, the front wiping side of the gaskets on both lateral sides of the second to rise panel or group of panels rising between two of the first to rise spaced apart panels wipes the contact surface of both of the next adjacent first to rise panel or group of panels, with the pressure application back side of the gaskets pressing the front wiping side against the contact surface of the next adjacent first to rise panel or group of panels.

In an exemplary embodiment, the assembly may include at least one panel raising mechanism for the panels, either operatively associated with a single panel or with a group of the panels to raise a panel or a group of panels upwardly from the support pan to the upright raised position. In an exemplary embodiment in which each panel has a mechanism for elevating the lowered panel, the mechanism may comprise a lift arm positioned under each panel normal to the first axis of rotation and pivotingly supported on the support pan for rotation upwardly from a lowered position about a substantially horizontal second axis of rotation that is parallel to the first axis of rotation. The lift arm has an aft portion and a fore portion. The mechanism may further comprise a powered driver fixed on the support and a driven member connected proximately to the powered driver and distally to the aft portion of the lift arm, whereby on activation of the driver the aft portion is drawn forward and the fore portion is rotated upward on the second axis to lift the panel rotationally upwardly on the first axis to a raised position. The mechanism may further comprise a controller for the powered driver of each panel to sequentially actuate the drivers of the first and second panels in that order or to power all the drivers at once to lift a group of panels all at the same time.

In an exemplary embodiment, the fore portion of the lift arm is not connected to the bottom surface of a panel. A terminal end of the fore portion may have a low friction rub surface appended thereto, and the bottom surface of the panel where the terminal end contacts the panel during panel raising may have a low friction rub surface of length at least as long as an extent of travel of the terminal end along the bottom surface when raising the panel.

In an exemplary embodiment, the panels are buoyant passively responsive to a rise of water higher than the surface of the land in which the support pan is situated, to buoyantly rotate upwardly about the first axis. This is advantageous where the fore portion of the lift arm is not connected to the bottom surface of a panel, in that if a power failure occurs before the mechanical mechanism for raising the panels can be activated, the panels will passively rise essentially all at once, and if a power failure occurs after mechanical raising of panels has commenced but before all the panels are raised completely to full upright position, invading water impounded behind the not fully raised panels will buoy the panels to completion of rise, and if the not fully raised panels are nearly fully raised, hydrostatic pressure from the impounded water will push the panels to fully complete upright position. If the panels were connected to the fore portion of the lift arm, the connection would hold the panels to their less than full extent of rise, preventing the buoyant or hydrostatic completion of lift.

Referring now to the drawings, reference numeral 10 in FIG. 1 indicates an exemplary embodiment comprising a plurality of laterally next adjacent panels 12 (in FIG. 1, 12*a*, 12*b*, 12*c*). Each panel has a top surface 14, a bottom surface 16, a front end 18, a back end 20, and lateral sides 22, 24 of a length that runs from back end 20 to at least near front end 18 of panel 12. The top surface 14 of each panel is substantially horizontally disposed relative to earth in a lowered position 26 within a support 28 (panel 12*c* is slightly raised from horizontal to show the top surface and other details of the panels 12 not viewable in panels 12*a*, 12*b*). Support 28 is in the form of a housing or pan in which the panels 12 reside in lowered position. Panels 12 are hingedly rotatable on a substantially horizontal first axis of rotation 29 at back ends 20 of panels 12 to rotate upwardly in the same rotational direction to a raised position (as shown for panels 12*a*, 12*b*) where water will be contained behind bottom surface 16.

Panel 12 may be made of a plurality of repeating assembly units comprising hollow tubes 40, for example, tubes rectilinear in cross section, connected, for example, by stitch welding, along the length of a tube 40. Panels 12 are kept vertical against the water (water is at the bottom surface of the raised panels 12) by foldable tensioning retention arms 30 pivotally attached to panel anchor plates 32. Tensioning member retention arms 30 are anchored to pan anchor plates 34 at the bottom 36 of pan 28. Retention arms 30 have a single upper part slotted in a lower reach of the upper part and two lower parts which are connected by a pin passing through the slot of the upper part. A plurality of support beams 38 are affixed to the bottom surface 16 of each panel 12 from back end 20 to front end 18. Support beams 38 stiffen panels 12 and aid the panels to be vertically weight bearing in horizontal disposition in the pan so that the panels may serve over-trafficking, for example pedestrian or vehicular traffic atop the panels. Pan 28 includes a pan drainage system comprising one or more horizontal troughs 41 draining into a manifold 42 for connection to outlets (not shown).

A lift arm 44 comprising an aft portion 44*a* and a fore portion 44*b* is positioned under each panel normal to the first axis of rotation 29 and is pivotingly supported on the pan 28 for rotation from a substantially horizontal disposition upwardly about a substantially horizontal second axis of rotation 46 that is parallel to first axis of rotation 29. A powered driver 48 is fixed on pan 28. A driven member 50 is connected proximately to powered driver 48 and distally to aft portion 44*a* of lift arm 44. On activation of driver 48, aft portion 44*a* of lift arm 44 is drawn forward and fore portion 44*b* is rotated upward on second axis 46 to lift panel 12 rotationally upwardly on first axis 29 to a raised upright position. A controller for the powered driver 48 of each panel 12 actuates the drivers of the panels in a predetermined sequence.

Referring to FIG. 1, end panel 12*b* is adjacent an upright wall 66 presenting a contact surface. End panel 12*b* has a gasket 52 on both panel lateral sides 22, 24. The gasket on lateral side 24 of panel 12*b* sealingly wipes wall 66. Referring to FIGS. 2-5 end panel 12*b* has a gasket 52 on panel lateral side 22 that is next adjacent to another panel 12 (panel 12*a* in FIGS. 2-5). The gasket on lateral side 22 of end panel 12*b* is held (FIGS. 2-5) by a gasket holder 54 attached to the panel lateral side. (A like gasket holder holds the unseen gasket 52 on the side 24 next to wall 66.) Gasket 52 runs parallel to the length of the lateral side 22 of panel 12*b* (see FIGS. 2-5) and does the same on the unseen lateral side 24 next to wall 66. Each panel 12 that in the embodiments of FIGS. 1-5 is not an end panel also has a contact surface 56 on the other lateral side 24 of such panel (i.e., other than the lateral side 22 to which the gasket is attached). This is the "first configuration" mentioned above in which one panel has (a) a gasket attached to a panel lateral side that is next adjacent to the other panel, the gasket coursing the length of the panel lateral side and (b) a contact surface at the other lateral side of such panel than the lateral side to which the gasket is attached, that contact surface running the length of such other lateral side. In FIGS. 2-5, the right and left portions of respective next adjacent panels 12*b* and 12*a* are viewed. Lateral side 22 holding gasket 52 is on the right portion of panel 12*b* and lateral side 24 presenting a contact surface 56 is on the left portion of panel 12*a*.

Panels 12*a*, 12*b* and 12*c* are raised sequentially, 12*c* before 12*a* before 12*b* (12*c* is to be imagined raised albeit lowered in FIG. 1 to provide a view of the top surface of the panels), so that (speaking only of panels 12*a* and 12*b*) a contact surface 56 of panel 12*a* is raised before the gasket 52 on adjacent panel 12*b* is raised, thereby to present contact surface 56 for contact of gasket 52 of the next adjacent panel 12*b* when panel 12*b* is raised. Pressure of gasket 52 of panel 12*b* against contact surface 56 of panel 12*a* resists the hydrostatic force of water contained behind the bottom surfaces 16 of the panels, providing a positive seal against water passing between the panels 12*a* and 12*b*. The sequencing can raise the second to rise panel 12*b* just a few seconds after the first raised panel 12*a*, it sufficing that the first raised panel 12*a* is just ahead of the second to raise panel 12*b* so that the contact surface 56 is present for engagement of the gasket 52. Next adjacent panels such as panels 12*a* and 12*b* cooperate in a one after the other raising sequence to form a sealing closure between them. A series of next adjacent panels can be erected to an upright position by the "push of a button" in circuitry containing controllers operating the driving mechanism described, thus in effect "zipping up" a wall along an area to be protected from flooding water invasion.

Figure 3:
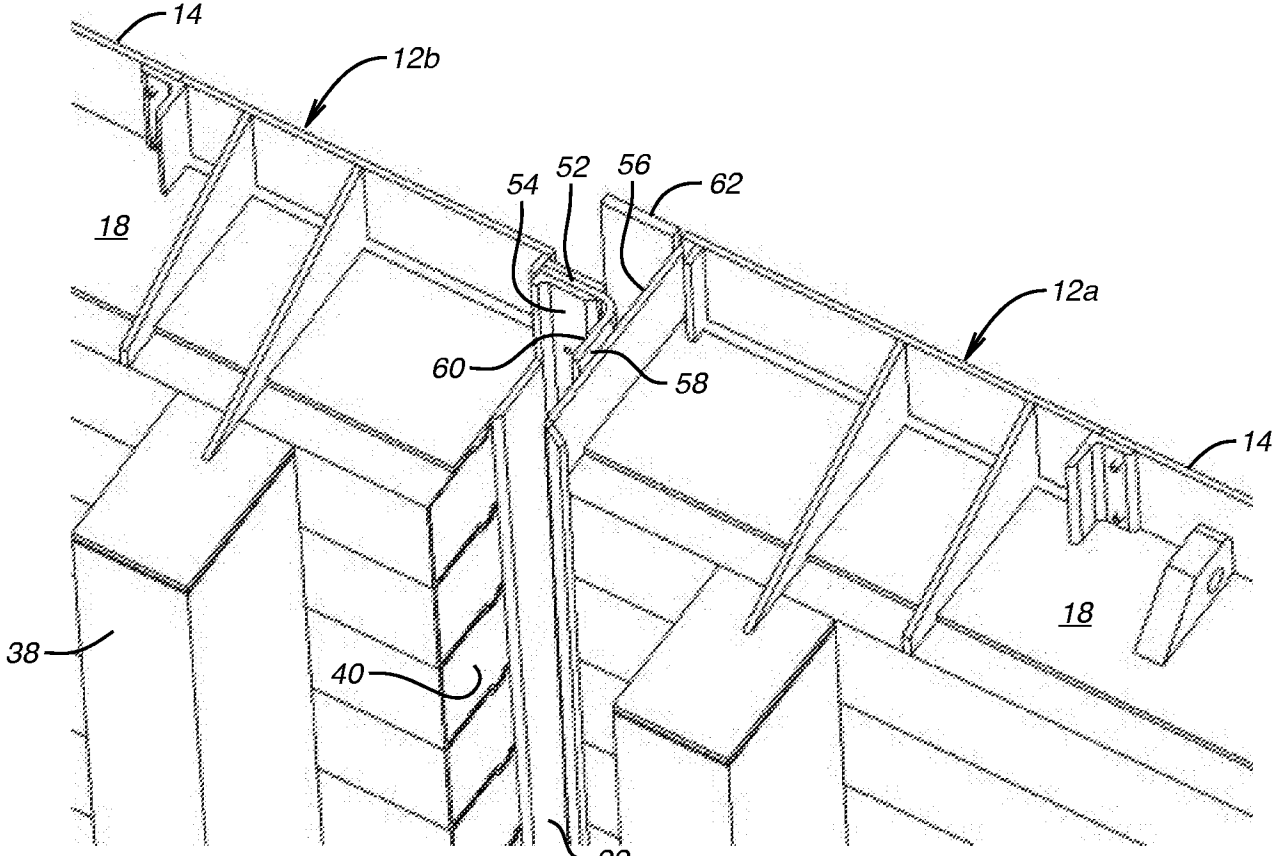
Figure 4:
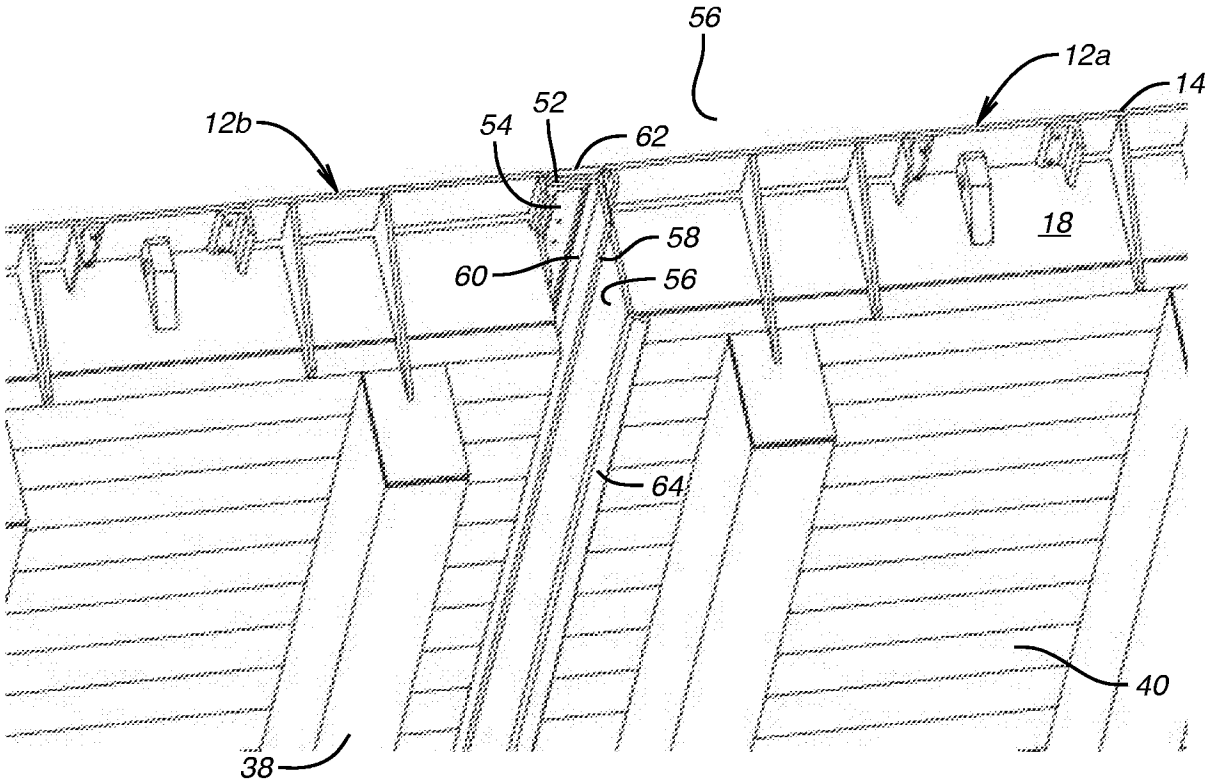
Figure 5:
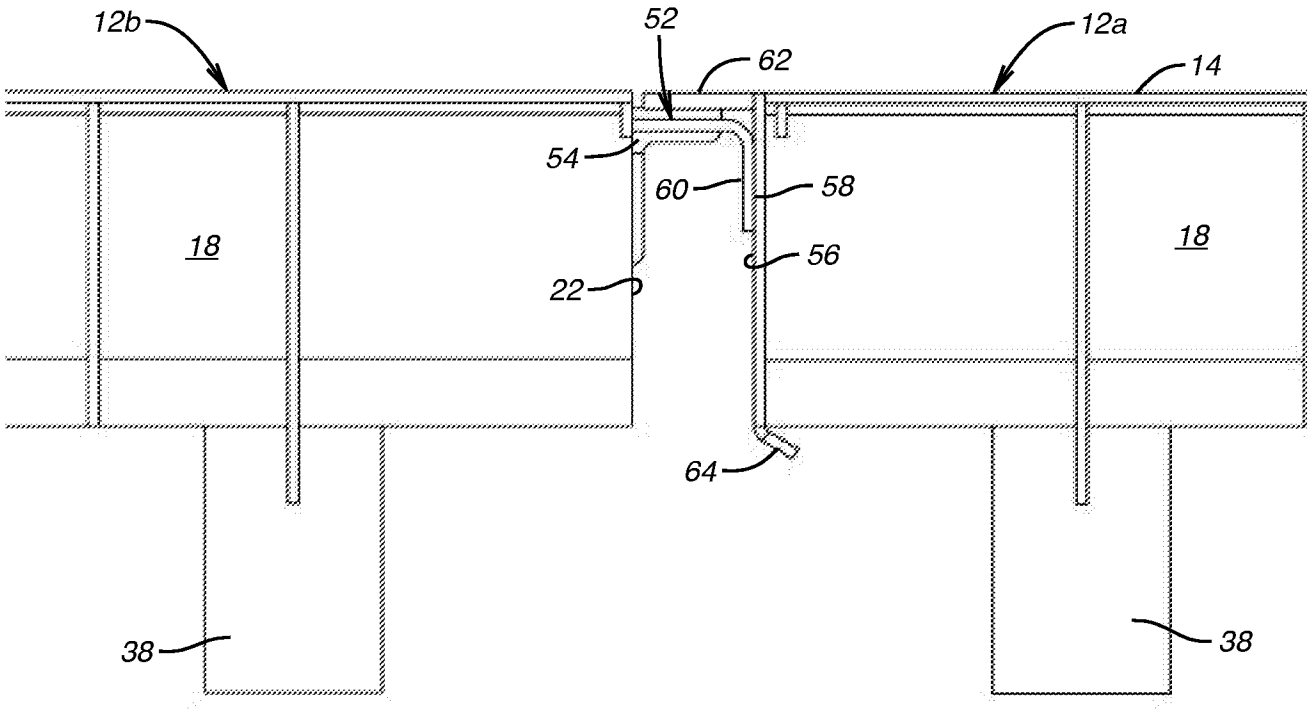

The gasket 52 illustrated in FIGS. 2-5 has a front wiping side 58 and a pressure application back side 60 (pressure application back side 60 is viewable in FIGS. 3-5). Each panel 12 except the end panel in the embodiments of FIGS. 1-5 has a flat contact surface 56 on the other lateral side of such panel (side 24) than the lateral side 22 to which gasket 52 is attached. On sequential rise of panels 12*a* and 12*b*, the front wiping side 58 of gasket 52 of panel 12*b* wipes the contact surface 56 of the next adjacent panel 12*a* with the pressure application back side 60 of gasket 52 pressing the front wiping side 58 against the flat contact surface 56 of next adjacent panel 12*a*.

In FIGS. 2-5, the top surface 14 of next adjacent panel 12*a* extends at 62 over gasket 52 and gasket holder 54 of panel 12*b* to prevent debris from falling between adjacent panels 12*a*, 12*b* when panels 12*a*, 12*b* are in a lowered position in pan 28. In an exemplary embodiment alternative to a wiping gasket, contact surface 56 may be a flange surface that is part of and extends from lateral side 24 of panel 12*a* and occupies the same position as extension 62, and gasket 52 may be a compression gasket to form a compression seal when pressed against such flange surface that is part of and extends from lateral side 24 of panel 12*a*. To distinguish between the two types of gaskets when on or the other is meant, a wiping gasket is numbered as 52*a* and a compression gasket is numbered as 52*b*.

In an exemplary embodiment, as shown in FIG. 5, contact surface 56 of panel 12*a* angles toward the bottom surface 16 of panel 12*a* at a junction between the lateral side 24 carrying contact surface 56 and bottom surface 16, providing a guide 64 for front wiping side 58 of gasket 52 to come into contact with contact surface 56 of next adjacent panel 12*a*.

Figure 6:
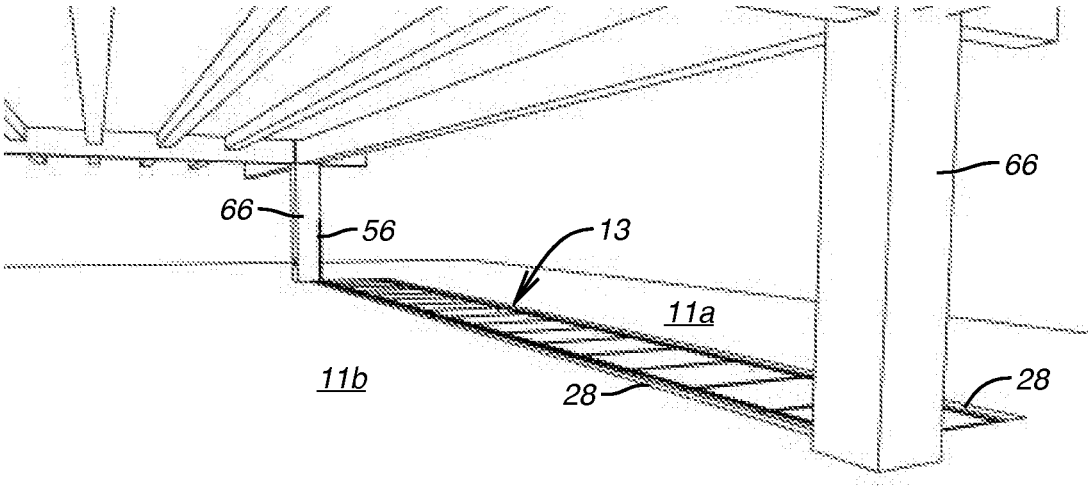
Figure 7:
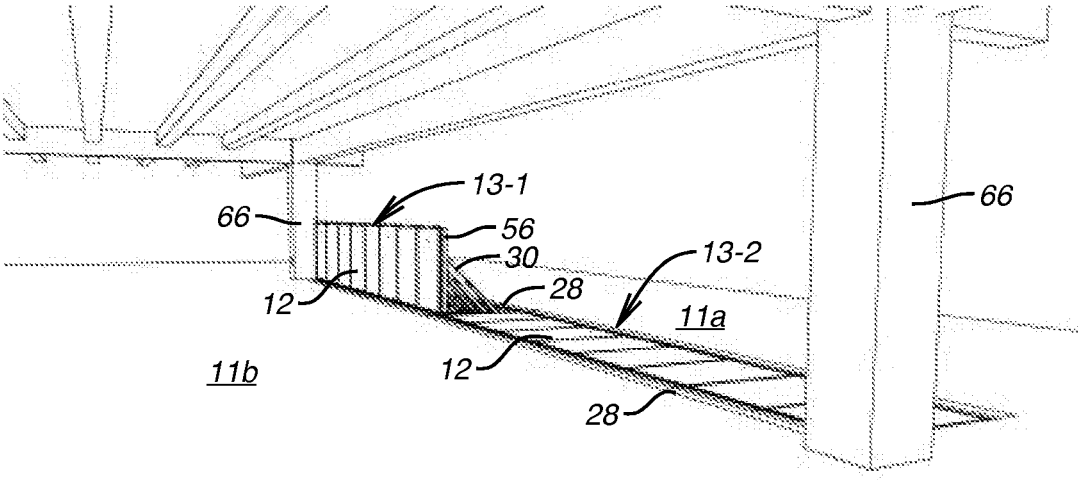

Referring now to FIGS. 6-9, a linear array of a group of panels 13 in FIG. 6 is substantially horizontally resident in a support pan 28 on a land surface 11. The interior panels 12 of the group of panels 13 resident in support pan 28 each have a gasket 52 contacting a contact surface 56 of a next adjacent panel 12. On both ends of the array 13 is an upright support structure 66 fixed to the land; as depicted, support structure 66 is a support pillar for an overhead structure such as an elevated freeway. Support structures 66 have a contact surface 56 (FIG. 6) as tall as the panel 12 next adjacent to the structure 66 when the next adjacent panel 12 is in an upright position (FIG. 7). The lateral side of panel 12 next adjacent upright structure 66 attaches a gasket for sealing contact with contact surface 56 of upright structure 66. In FIG. 7, a first group of panels 13-1 is raised from pan 28 to an upright position. This could have been by panels 12 of group 13-1 raising sequentially one after the other or by raising all at the same time. If all at the same time, because the interior panels 12 of the group of panels 13-1 when resident in support pan 28 each had a gasket 52 contacting a contact surface 56 of a next adjacent panel 12, the gasket 52 already was in contact with the contacting surface 56 and retained that contact when the panels 12 of group 13-1 were raised all at the same time.

Figure 8:
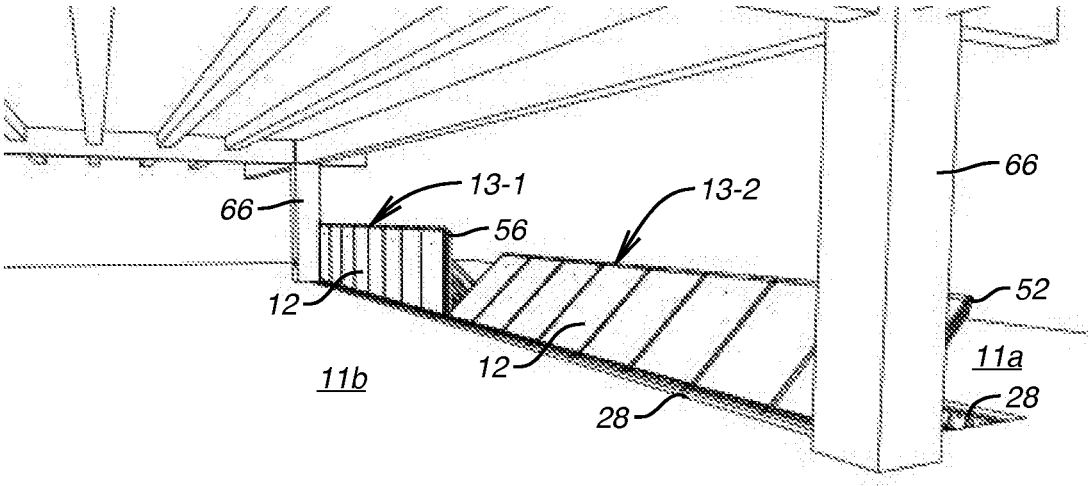
Figure 9:
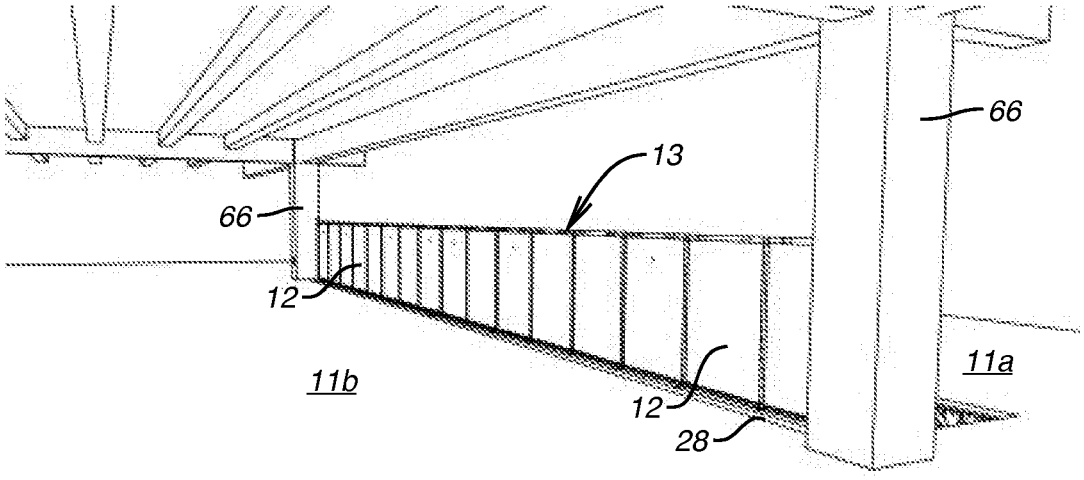
Figure 10:
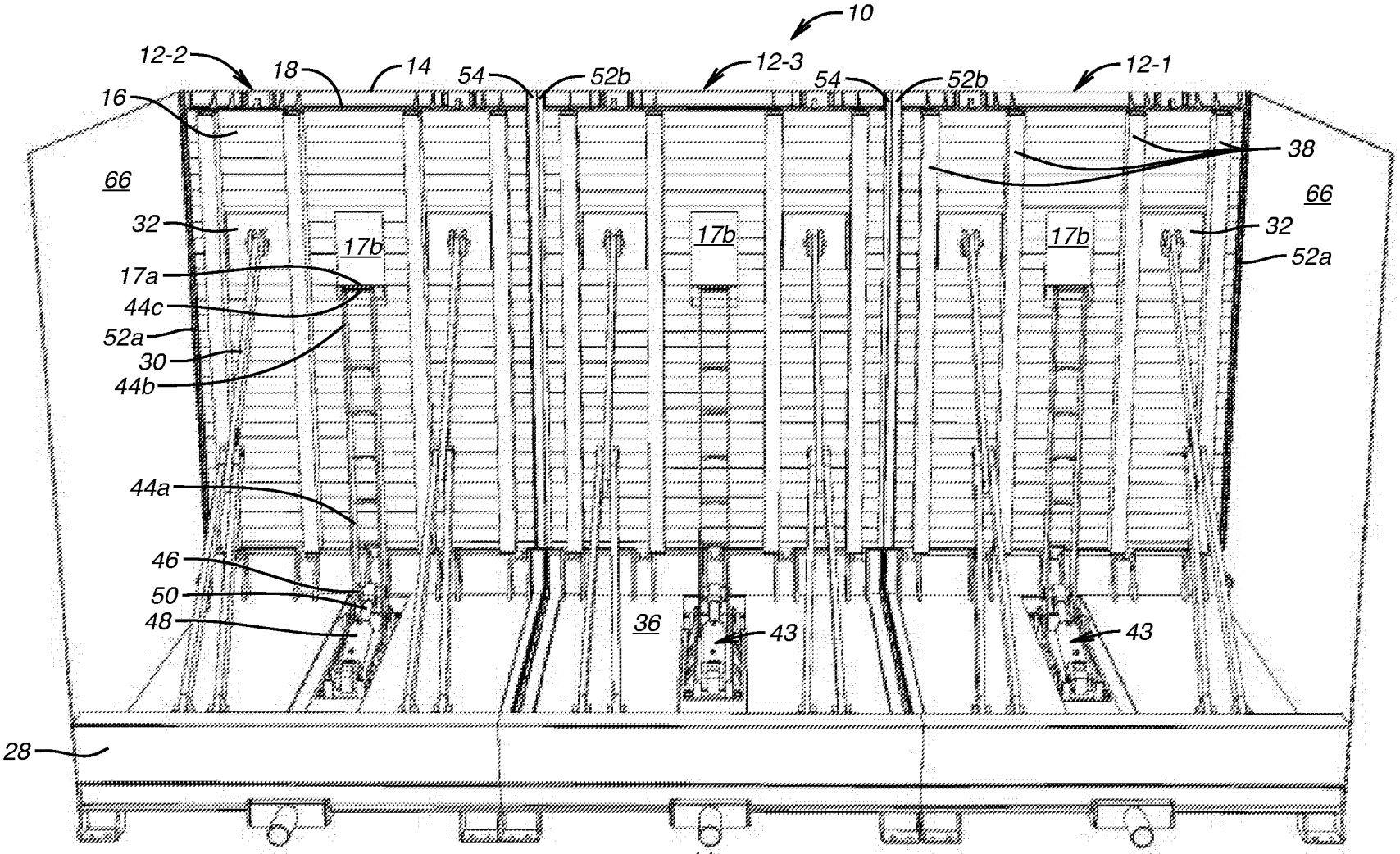

In FIG. 8, a second group of panels 13-2 is raised from pan 28 to an upright position all at the same time. In FIG. 9, all panel of groups 13-1 and 13-2 are erect. The wet side of the barrier is behind the barrier at 11*a*. The dry side of the barrier 10 is in front of the barrier at 11*b*.

Referring now to FIGS. 10-23, there is depicted an exemplary embodiment that complies with the configuration referred to above generally as the "second configuration." The exemplary embodiments of FIGS. 10-23 depict a linear arrangement of three panels between end walls 66. This is only a minimum number of panels for a "second configuration" to illustrate the principle of operation of panels in the second configuration. A long linear arrangement of panels in the "second configuration" will have panels having gaskets 52 on both left and right lateral sides next adjacent between and separating panels having a contact surface on both left and right lateral sides. Even the end walls 66 are not necessary. The panels of the "second configuration" can seal to a next adjacent panel 12 of a run of panels of the "first configuration, and panels of either configuration can seal to a next adjacent panel of a panels in a curved panels arrangement.

In FIGS. 1-5, the lateral side carrying gasket 52 on panel 12*b* is lateral side 22, and the contact surface on panel 12*a* is on lateral side 24. In the following description of the exemplary embodiments of FIGS. 1-23, the lateral side of a panel carrying a gasket 52 is also referenced as a lateral side 22, and a lateral side of a panel presenting a contact surface is referenced as lateral side 24. However, unlike the embodiments of FIGS. 1-5 in which a single panel 12 had both a lateral side 22 carrying a gasket and a lateral side 24 presenting a contact surface, in the exemplary embodiments of FIGS. 10-23 the panel carrying a gasket has two lateral sides 22 carrying a gasket and, other than end panels of the linear arrangement (such as illustrated in FIGS. 10-23 which are characterized as having a contact surface on at least one lateral side next adjacent the panel carrying gaskets on both lateral sides), the panels presenting a contact surface have two lateral sides 24. End panels can have a gasket for sealing against an upright structure 66 such as the wall 66 in FIGS. 1-23. There are two of the contact surface panels for each of the gasket carrying panels. To distinguish the panels 12 of the exemplary embodiments of FIGS. 10-23 from the panels of the exemplary embodiments of FIGS. 1-5, the panels of FIGS. 10-23 have a second number appended to the reference number 12. The panels presenting a contact surface on two lateral sides 24 are numbered as panels 12-1 and 12-2 and the panel carrying a gasket and having two lateral sides 22 is numbered as panel 12-3.

Figure 11:
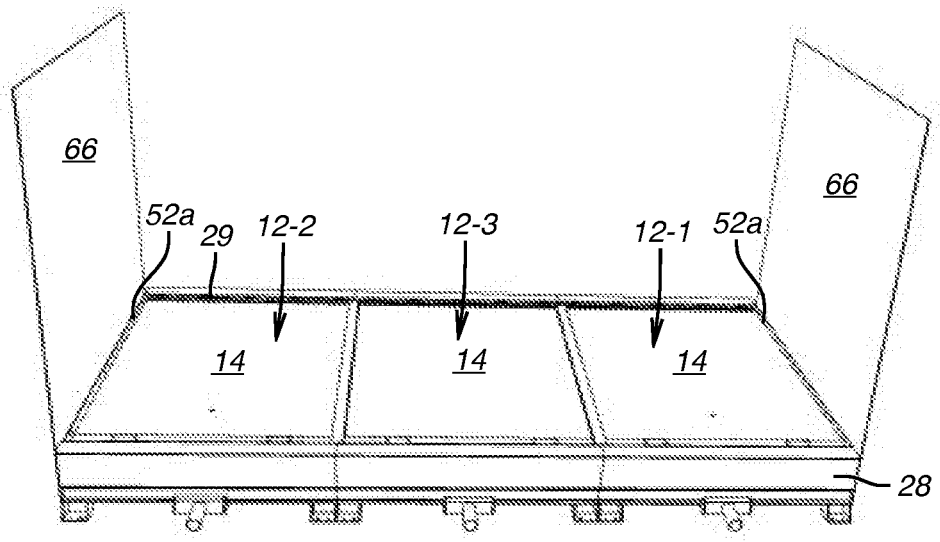
Figure 12:
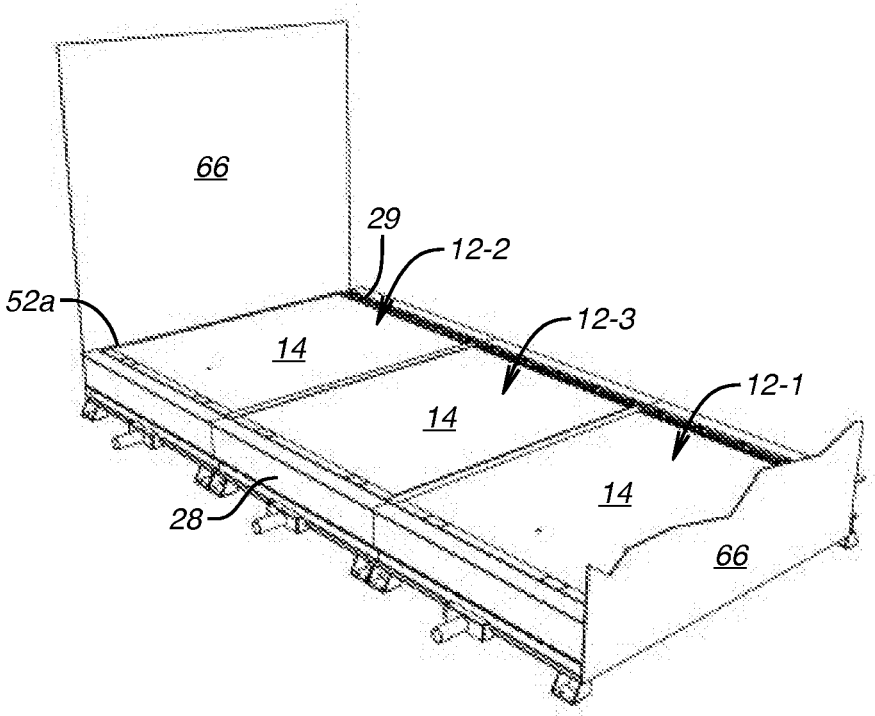

Referring mow to the exemplary embodiments of FIGS. 10-23, a linear array of a plurality of next adjacent panels 12-1, 12-2 and 12-3 is depicted. Each panel has a top surface 14, a bottom surface 16, a front end 18, a back end 20, and lateral sides 22, 24 both at an imagined projected intersecting angle to a shoreline and of a length that runs from back end 20 to at least near the front end 18 of the panel. Referring to FIGS. 11, panels 12-1, 12-2 and 12-3 are in a lowered position residing substantially horizontally in support pans 28. Panels 12-1, 12-2 and 12-3 are hingedly rotatable on a substantially horizontal first axis of rotation 29 at back end 20 of the panels to rotate upwardly from pan 28 to an upright raised position where invading flood water will be contained at the bottom surface 16 of the panels. An upright structure in the form of a wall 66 is located adjacent end panels 12-1 and 12-3.

As in the instance of the embodiments of FIGS. 1-5, a mechanism 43 for raising panels 12-1, 12-2 and 12-3 comprises for each panel a lift arm 44 positioned under the panels normal to first axis of rotation 29 and pivotingly supported on support pan 28 for rotation from a lowered position upwardly about a substantially horizontal second axis of rotation 46 that is parallel to first axis of rotation 29. Lift arms 44 have an aft portion 44*a* and a fore portion 44*b*. A powered driver 48, suitably a hydraulic ram, fixed on support pan 28 drives a driven member 50 connected proximately to powered driver 48. Driven member 50 is connected distally to aft portion 44*a* of lift arm 44, whereby on activation of each driver 48, aft portion 44*a* is drawn forward and fore portion 44*b* is rotated upward on second axis 46 to lift panels 12-1, 12-2 and 12-3 rotationally upwardly on first axis 29 to the raised position depicted in FIG. 10.

In the embodiments of FIGS. 10-23, the fore portion 44*b* of lift arm 44 is not connected to bottom surface 16 of a panel 12-1, 12-2 or 12-3. A terminal end 44*c* of fore portion 44*b* has a low friction rub surface 17*a* affixed thereto and the bottom surface 16 of a panel 12-1, 12-2 or 12-3 where the terminal end 44*c* contacts the panel during panel raising has a low friction rub surface 17*b* affixed along bottom surface 16. Rub surface 17*b* has a length at least as long as an extent of travel of terminal end 44*c* when raising a panel 12-1, 12-2 or 12-3. The rub surfaces 17*a*, 17*b* reduce frictional contact between the terminal end 44*c* and the bottom surface 15 of the panels thereby facilitating the raising operation and at the same time protecting the bottom surface 16 of the panels from marring by the unconnected terminal end 44*c* that in the absence of the rub surfaces might lead to deterioration of the panel in a seaside environment.

In an exemplary embodiment, panels 12-1, 12-2 and 12-3 are buoyant to buoyantly rotate upwardly about the first axis 29, passively responsive to a rise of water higher than wet side surface 11*a* of land 11 in which the support pan 28 is situated. In the event of a power loss defeating the operation of mechanism 43 for active elevation of the panels in advance of a threatened storm, the panels can still rise, albeit passively. The buoyancy feature is especially helpful in the event that a power loss occurs when the panels are partially but not fully raised. Water impounded behind the partially raised panels will float and hydrostatically continue the rise and close the panels to full upright position. This closure is possible because the fore portion 44*b* of lift arm 44 is not connected to bottom surface 16 of a panel 12-1, 12-2 or 12-3. If panels 12-1, 12-2 and 12-3 were connected to fore portion 46*b* of lift arm 46, the connection would hold the no longer powered panels to their less than full extent of rise, preventing the buoyant or hydrostatic completion of lift.

Tensioning members 30 connected to support pan 28 at pan anchor plates 34 and to the bottom surface 16 of each panel at panel anchor plates 32 prevent the panels from rotating past an upright position when loaded by hydrostatic pressure of water contained on the bottom side of the raised panels and make it possible to have a long run of panels without intermediate support posts.

The contact surface 56 on the lateral sides 24 of panels 12-1 and 12-2 runs the length of the lateral side 24. As described above, the contact surface may be the lateral side (in which instance a wiping seal 52*a* is employed on the lateral sides 22 of panel 12-3). In the embodiments of FIGS. 13-23, the contact surfaces 56 may be an extension of the top surface 14 of panels 12-1 and 12-2 projecting over lateral sides 24 substantially coplanar to top surface 14. As depicted the contact surfaces 56 are lateral projections 56*a* from lateral sides 24 and are substantially parallel to the top surface 14. Panel 12-3 next adjacent between and separating panels 12-1 and 12-2 has a compression gasket 52*b* attached on both lateral sides 22. Gasket 52*b* runs the length of lateral sides 22 of panel 12-3. Like the exemplary embodiments of FIGS. 1-9, the end panels 12-1 and 12-2 of exemplary embodiments of FIGS. 10-23 have a gasket 52*a* on the lateral side 22 facing the contact surface of wall 66, but only on that side.

Figure 13:
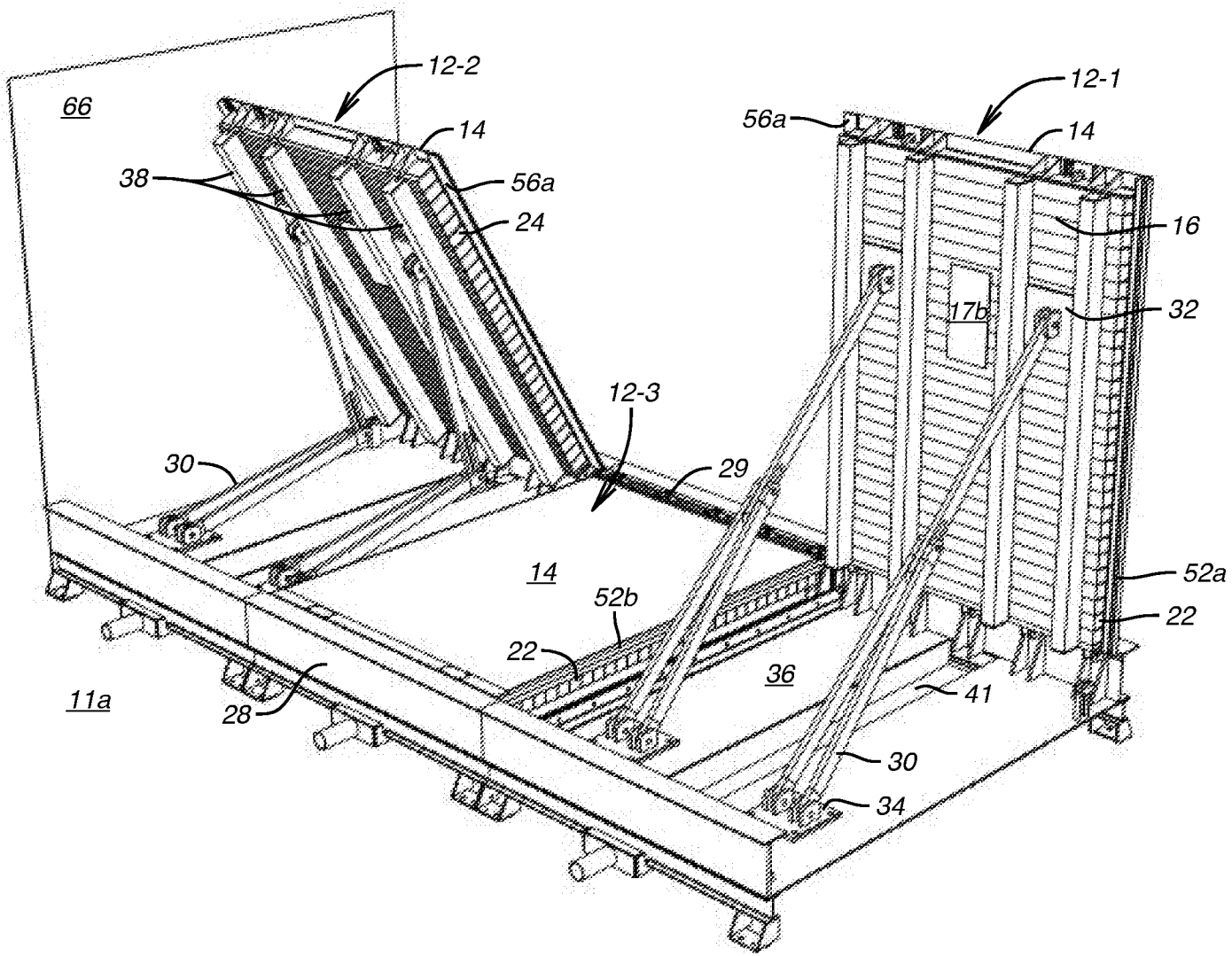
Figure 14:
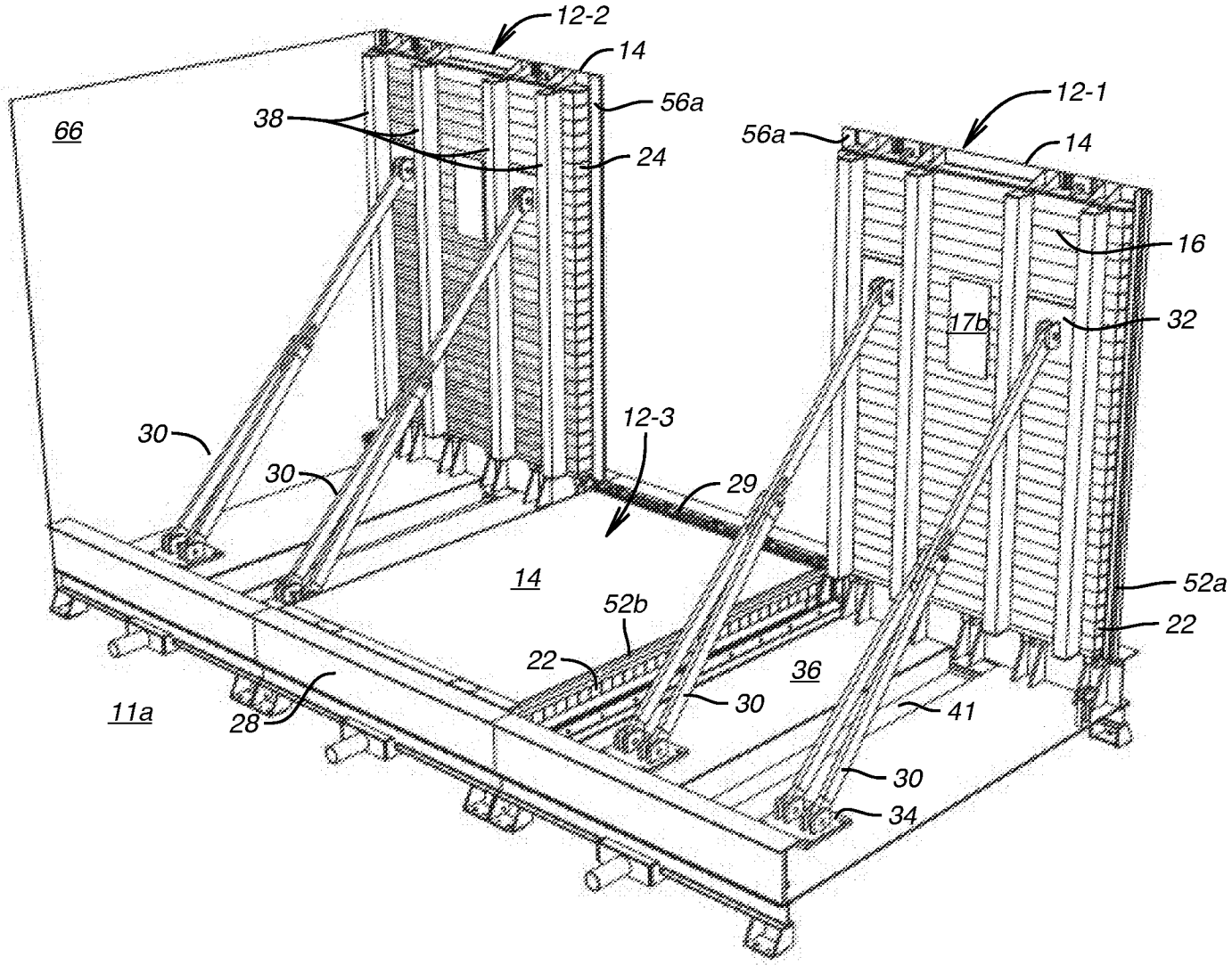
Figure 15:
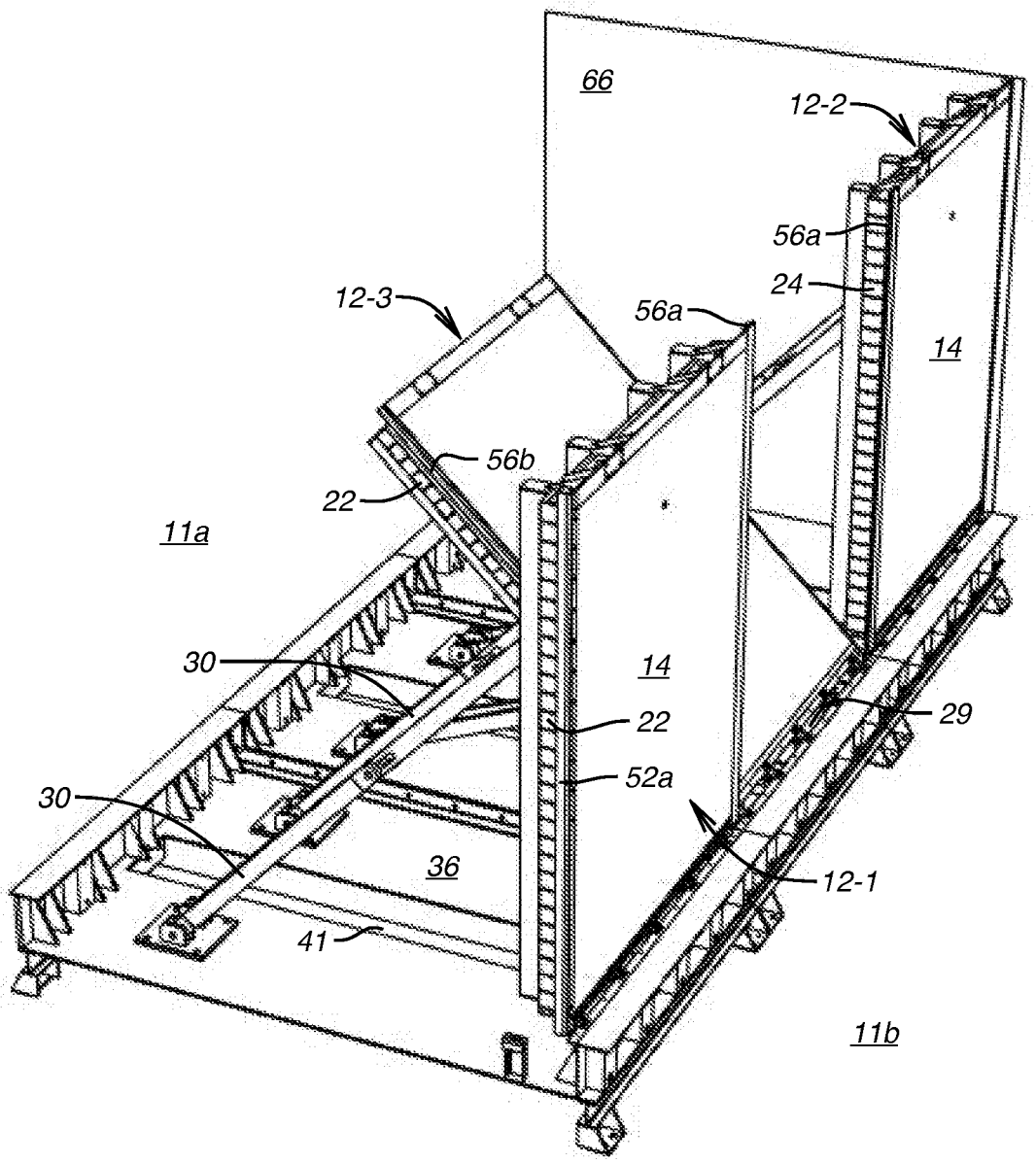
Figure 16:
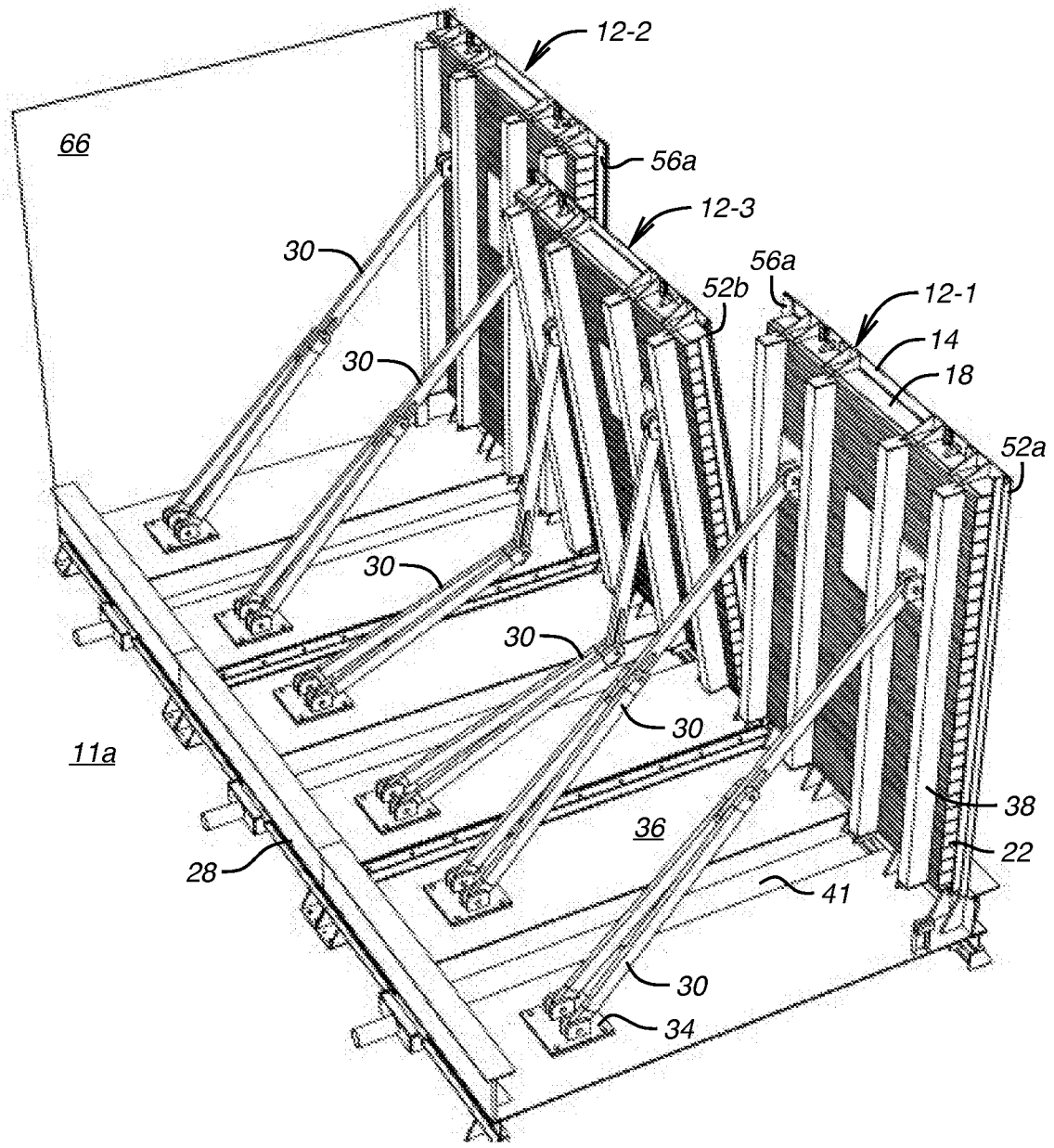
Figure 17:
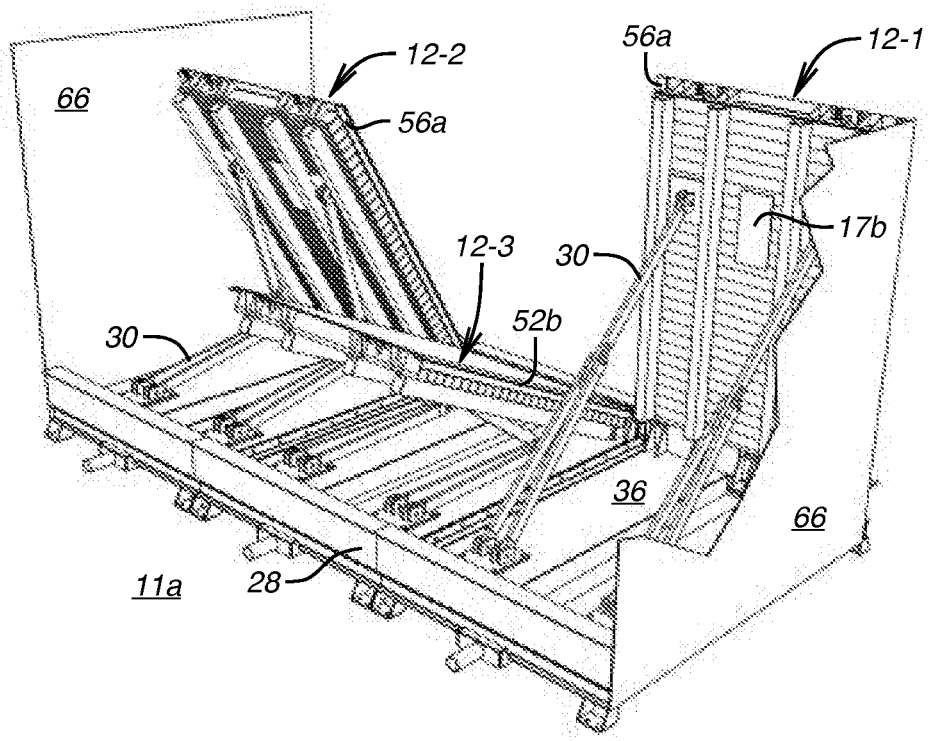
Figure 18:
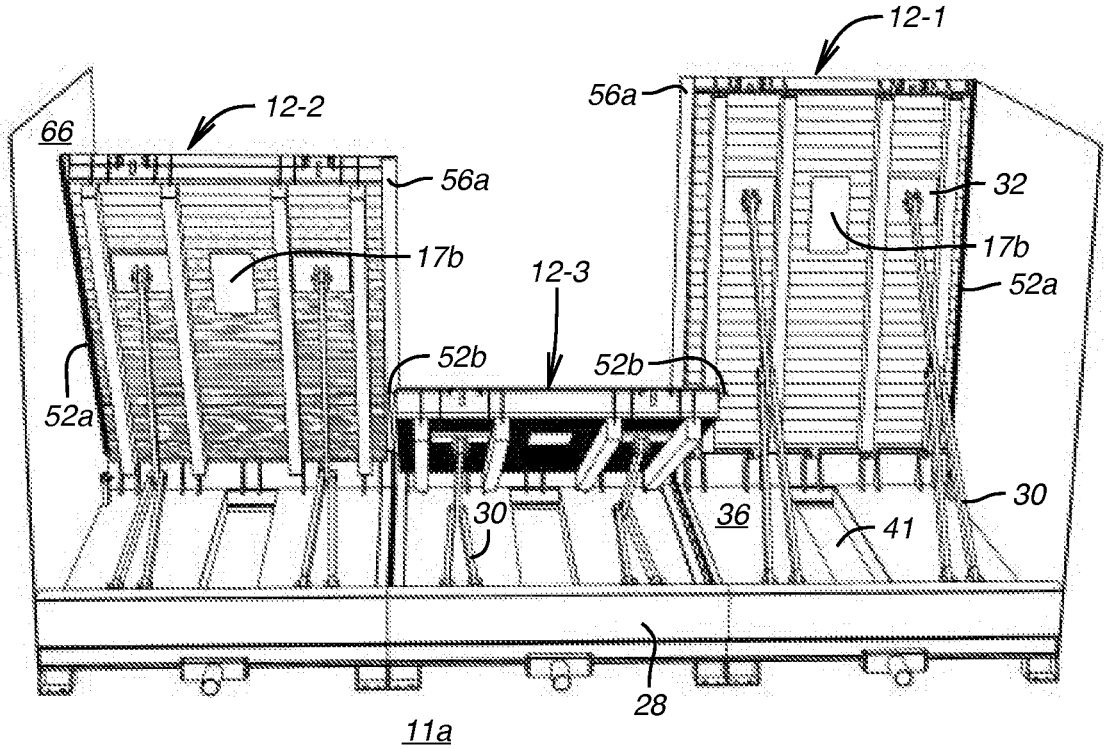

In FIG. 13, panel 12-1 has been fully raised by mechanism 28 (mechanism 28 depicted in FIG. 10 affixed in drain trough 41 in pan 28 is not pictured in FIGS. 13-18 to better reveal the contents of the assembly 10 but is to be understood present in FIGS. 13-18), and panel 12-2 is being raised by mechanism 28 (also not pictured but understood present). Panels 12-1 and 12-2 have contact surfaces 56*a* on at least one lateral side 24 (panels 12-1 and 12-2 as depicted are end panels and will have a gasket on the lateral side other than the contact surface side) and can be raised in any order or together all at once, but both are raised before panel 12-3 is raised fully upright. In FIG. 14, both panels 12-1 and 12-2 are fully raised and panel 12-3 is resident in support pan 28. FIGS. 13 and 14 are views from the wet side of the barrier 10. FIG. 15 depicts panel 12-3 carrying compression gaskets 52*b* being raised after panels 12-1 and 12-2 have been raised, and is viewed from the dry side of the barrier 10. FIG. 16 depicts panel 12-3 bearing compression gaskets 52*b* being raised after panels 12-1 and 12-2 have been raised, and is viewed from the wet side of the barrier. FIGS. 17 and 18 depict a sequence in which panel 12-1 has been raised, panel 12-2 is still being raised, and panel 12-3 is also being raised but later than panel 12-3, so that when panel 12-3 is fully raised both panels 12-1 and 12-2 having contact surfaces 56*a* will have risen for engagement of compression gaskets 52*b* against contact surfaces 56*a* of panels 12-1 and 12-2.

Figure 19:
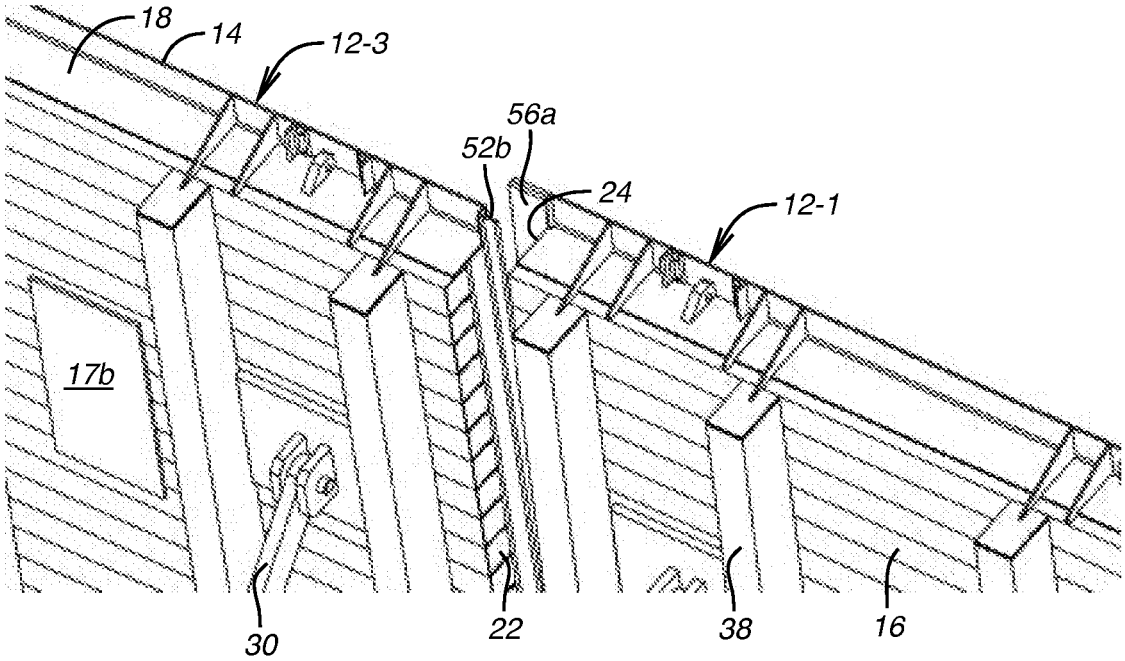
Figure 20:
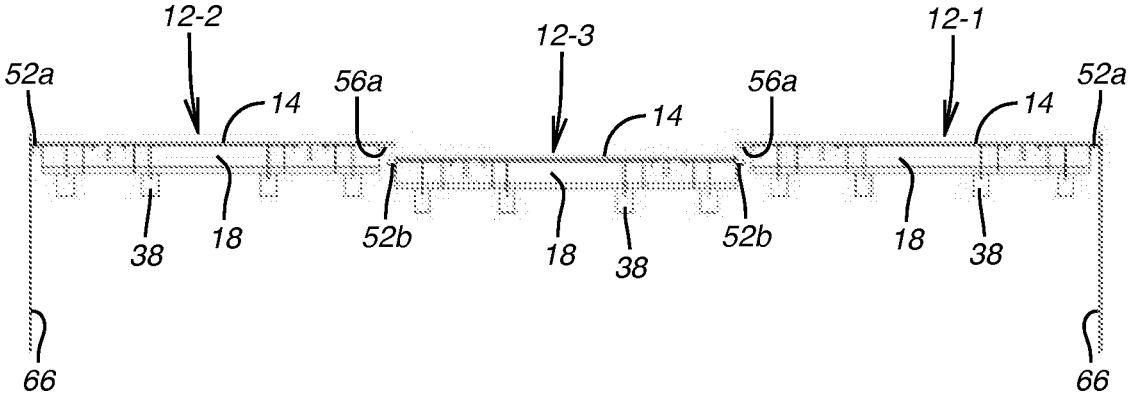
Figure 21:
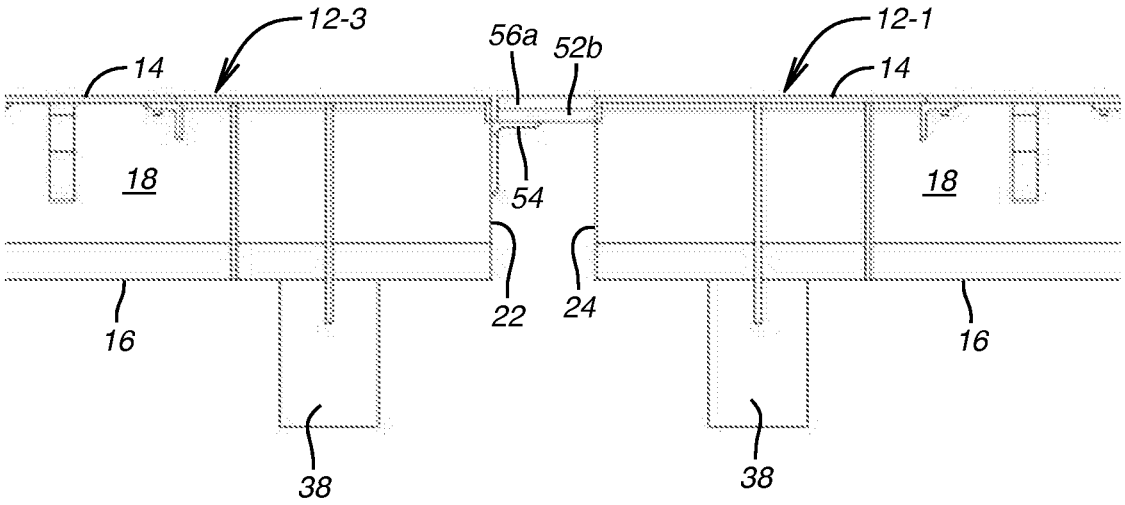
Figure 22:
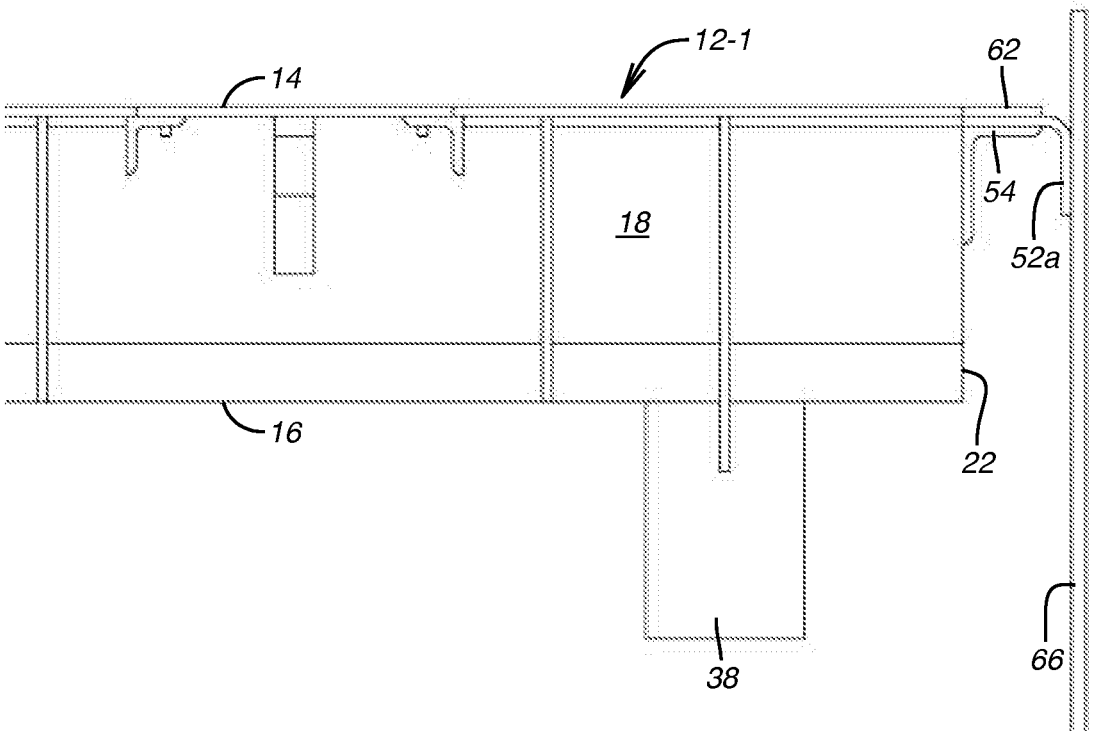
Figure 23:
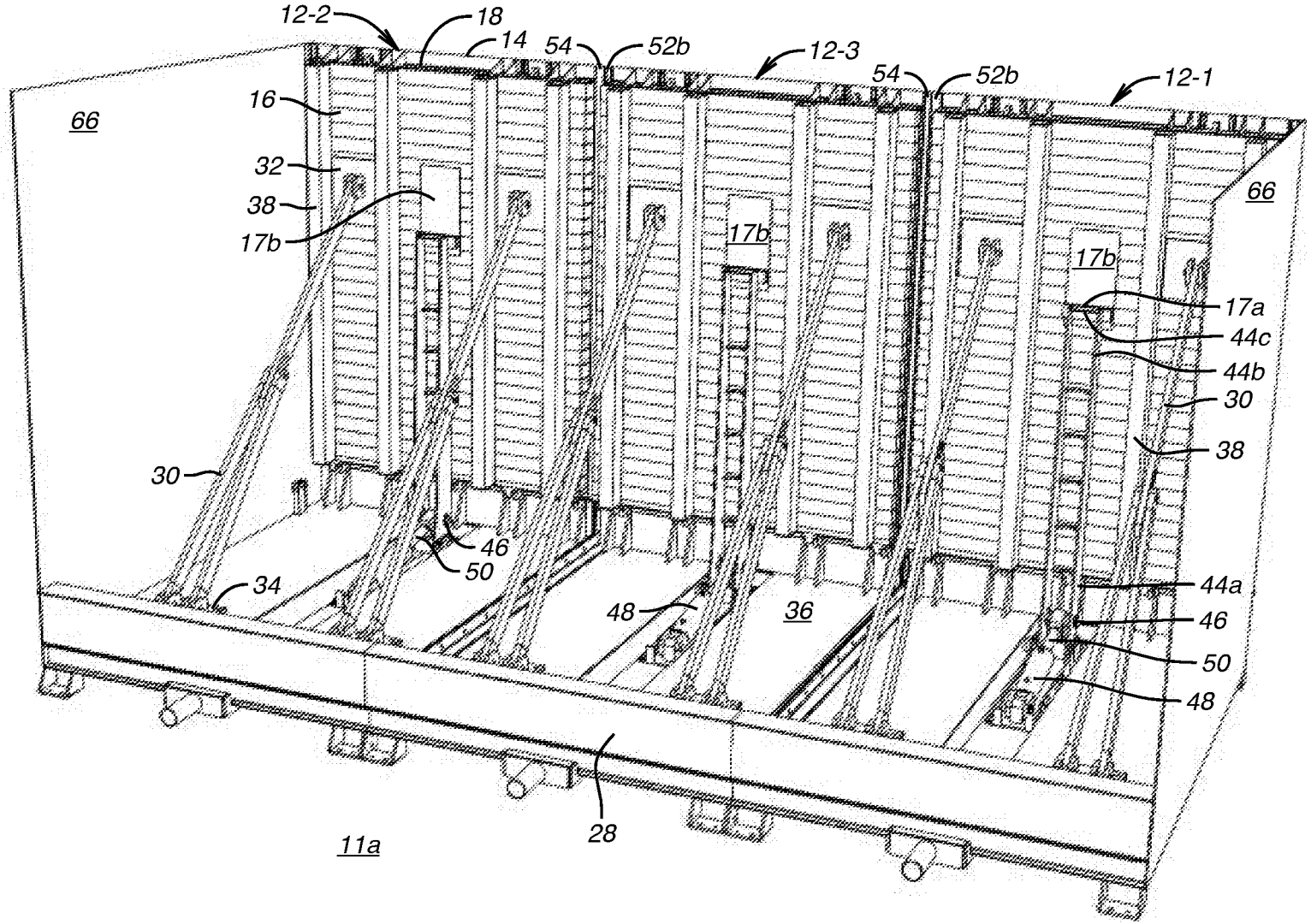

FIG. 19 depicts the presentation of contact surface 56*a* of panel 12-1 to the compression gasket 52*b* of panel 12-3. FIG. 20 in a top plan end view depicts the presentation of contact surfaces 56*a* of panels 12-1 and 12-2 to the compression gaskets 52*b* of panel 12-3. FIG. 21 is a close up top plan end view of contact surface 56*a* of panel 12-1 pressed by compression gasket 52*b* of panel 12-3, showing mount 54 of compression gasket 52*b* on lateral side 22. FIG. 22 is a partial top plan end view showing a wiper seal 52*a* closure of end panel 12-1 sealing against upright wall 66. FIG. 23 depicts panels 12-1, 12-3 and 12-2 raised on a continuous sealing barrier against water viewed from the wet side of barrier 10 and resumes the depiction of mechanisms 28.

Figure 24:
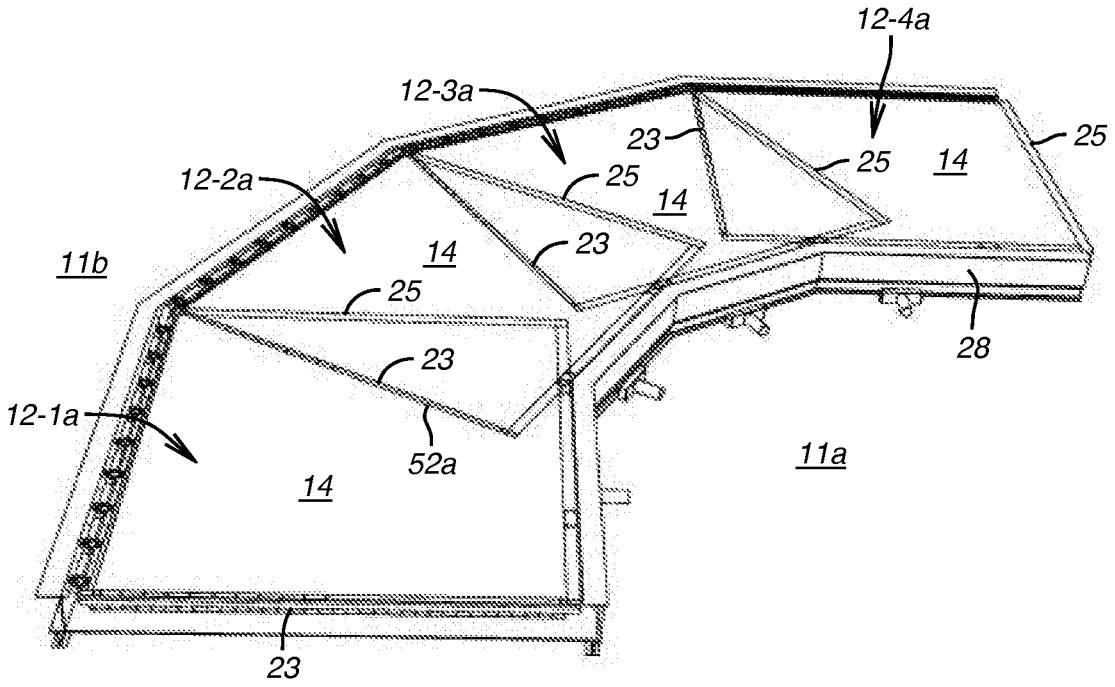
FIGS. 24-37 depict exemplary embodiments of flood control panels arranged in a curve in accordance with this invention.
Figure 25:
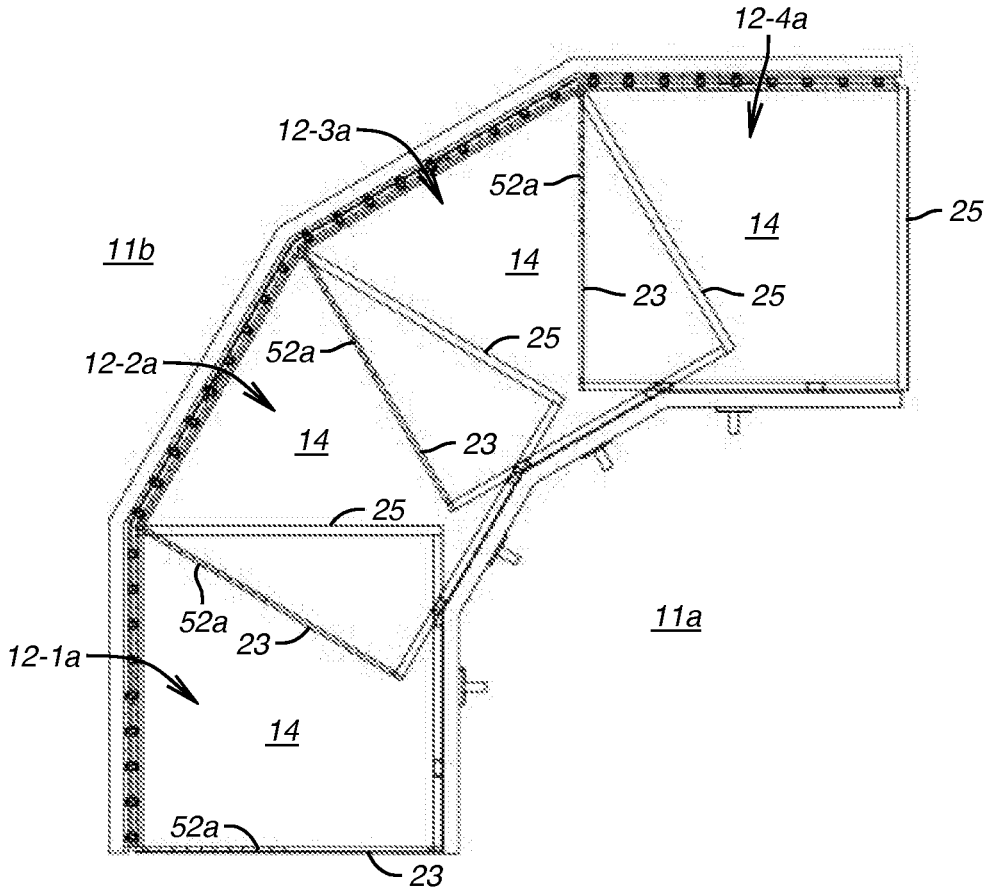

Turning now to FIGS. 24-29, FIG. 24 is a see-through side perspective view of four housed nested panels 12-1*a*, 12-2*a*, 12-3*a* and 12-4*a* arranged in an inside curve to go along an inwardly curving shoreline. The center of the inside curve is to the right of the viewer on the wet side 11 a of the flood barrier 10. The see-though view allows one to see a panel overlapping its next adjacent panel in an order in which the panels will be raised. Panel 12-1*a* overlaps panel 12-2*a*, which overlaps panel 12-3*a*, which in turn overlaps panel 12-4*a*. FIG. 25 is a top plan see-through view of the nested panels of FIG. 24.

Like the embodiments of FIGS. 1-5, panels 12-1*a*, 12-2*a* and 12-3*a* of the embodiments of FIGS. 24-29 are panels of the above mentioned "first configuration", in which a panel has a gasket attached to a panel lateral side that is next adjacent to another panel, and has a contact surface at the other lateral side of such panel than the lateral side to which said gasket is attached. Accordingly, panels 12-1*a*, 12-2*a* and 12-3*a* and so are not the same as panels 12-1, 12-2 and 12-3 described in respect to FIGS. 10-23, which are panels of the "second configuration" mentioned above. To denote this difference while maintaining the reference numeral "12" to indicate the panel element of the assemblies 10, the suffix "a" is added to -1, -2, -3 or -4 in the embodiments of FIGS. 24-29. However, unlike the exemplary embodiments of FIGS. 1-5, in which gasket 52 is fitted on the right lateral side 22 (right in the view of FIG. 2) of second to rise panel 12*b*, in the embodiments of FIGS. 24-29, gasket 52 is fitted to the left lateral side of a panel and the contact surface 56 is on the right lateral side. To signify this difference in the "first configuration" embodiments of FIGS. 24-29, the left side of the panel is indicated by reference numeral 23 and the right side (the contact surface side) is indicated by reference numeral 25. In the embodiments of FIGS. 24-29, in which the panels are arranged in an inside curve, lateral right side 25 has a contact surface angled acutely to top surface 14. This contact surface is indicated by reference numeral 56*c*.

Panels 12-1*a*, 12-2*a*, 12-3*a* and 12-4*a* as mentioned are next adjacent panels each having (a) a gasket 52 attached to a panel left lateral side 23, the gasket coursing the length of panel left lateral side 23, and (b) a contact surface 56*c* angled acutely to top surface 14 at the other (right) lateral side 25 of such panel, the contact surface 56*c* running the length of such other lateral side 25. The panels 12 in the embodiments of FIGS. 1-5 are sequentially raised right to left in the order first 12*c*, then 12*a* then 12*b*, but in the embodiments of FIGS. 25-29, the panels are sequentially raised one after the other left to right in the order 12-1*a*, 12-2*a*, 12-3*a* and 12-4*a*. Panel 12-1*a* overlapping panel 12-2*a* is first raised upright, presenting a right lateral side 25 contact surface 56*c*. When panel 12-2*a* is raised fully upright, gasket 52 in left lateral side 23 of panel 12-2*a* is impressed on contact surface 56*c* of right lateral side 25 of panel 12-1*a*, sealing the juncture between panel 12-1*a* and panel 12-2*a*. Gasket 52 in the embodiments of FIGS. 24-29 may be a wiping gasket 52*a* or a compression gasket 52*b*. When panel 12-2*a* is raised, it also presents a right lateral side 25 contact surface 56*c* for contacting by a gasket 52 on left lateral side 23 of a third to rise panel 12-3*a*, and when panel 12-3*a* is raised, it presents a right lateral side 25 contact surface 56*c* for contacting by a gasket 52 on left lateral side 23 of fourth to rise panel 12-4*a*.

Figure 26:
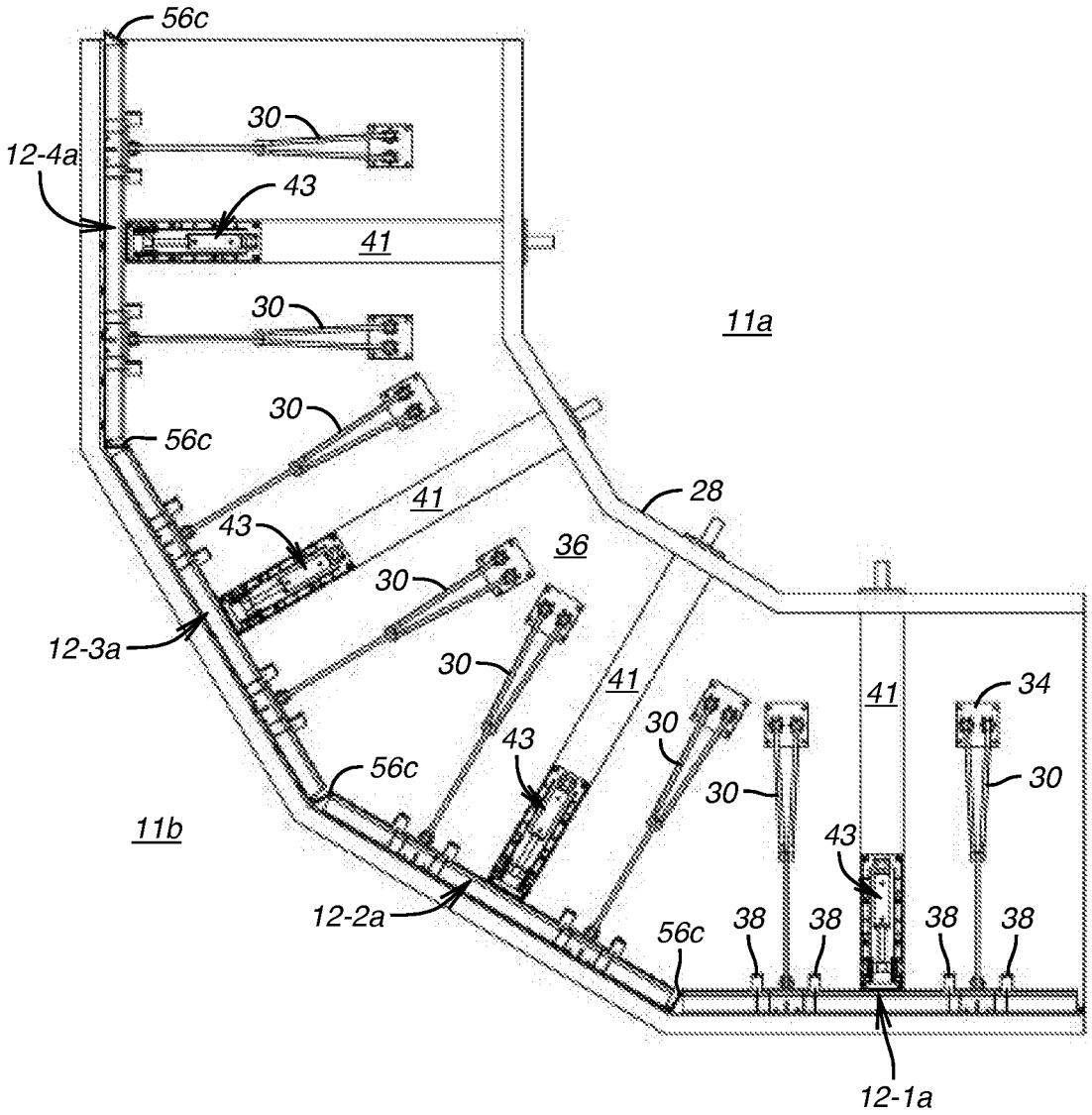

FIG. 26 is a top plan view of the fully raised panels 12-1*a*, 12-2*a*, 12-3*a* and 12-4*a* of FIG. 25, revealing contact surface 56*c* and mechanisms 43, tension arms 30, drainage troughs 41, all in a single support pan 28. The wet side is at 11*a*, the protected dry side is at 11*b*.

Figure 27:
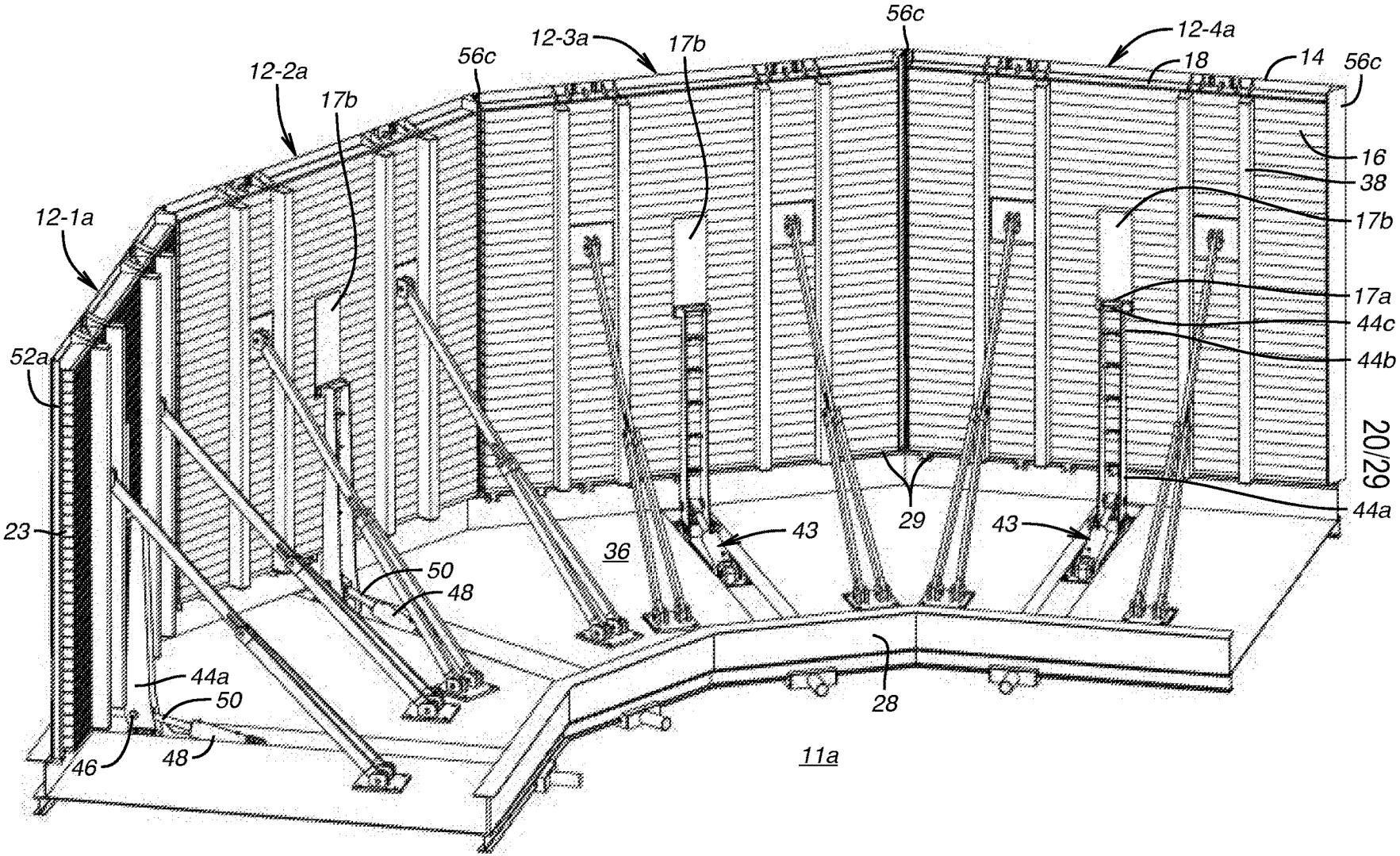
Figure 28:
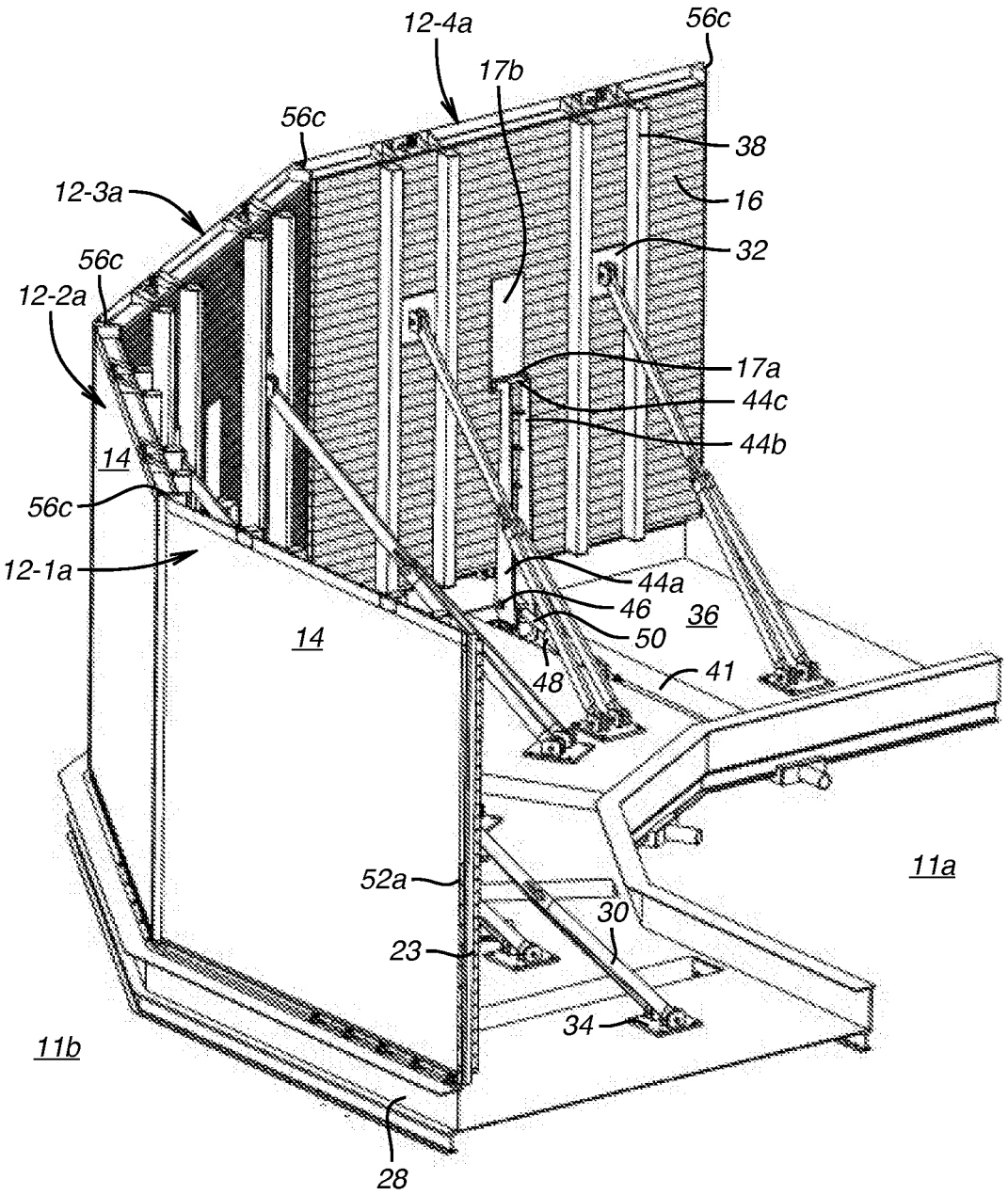
Figure 29:
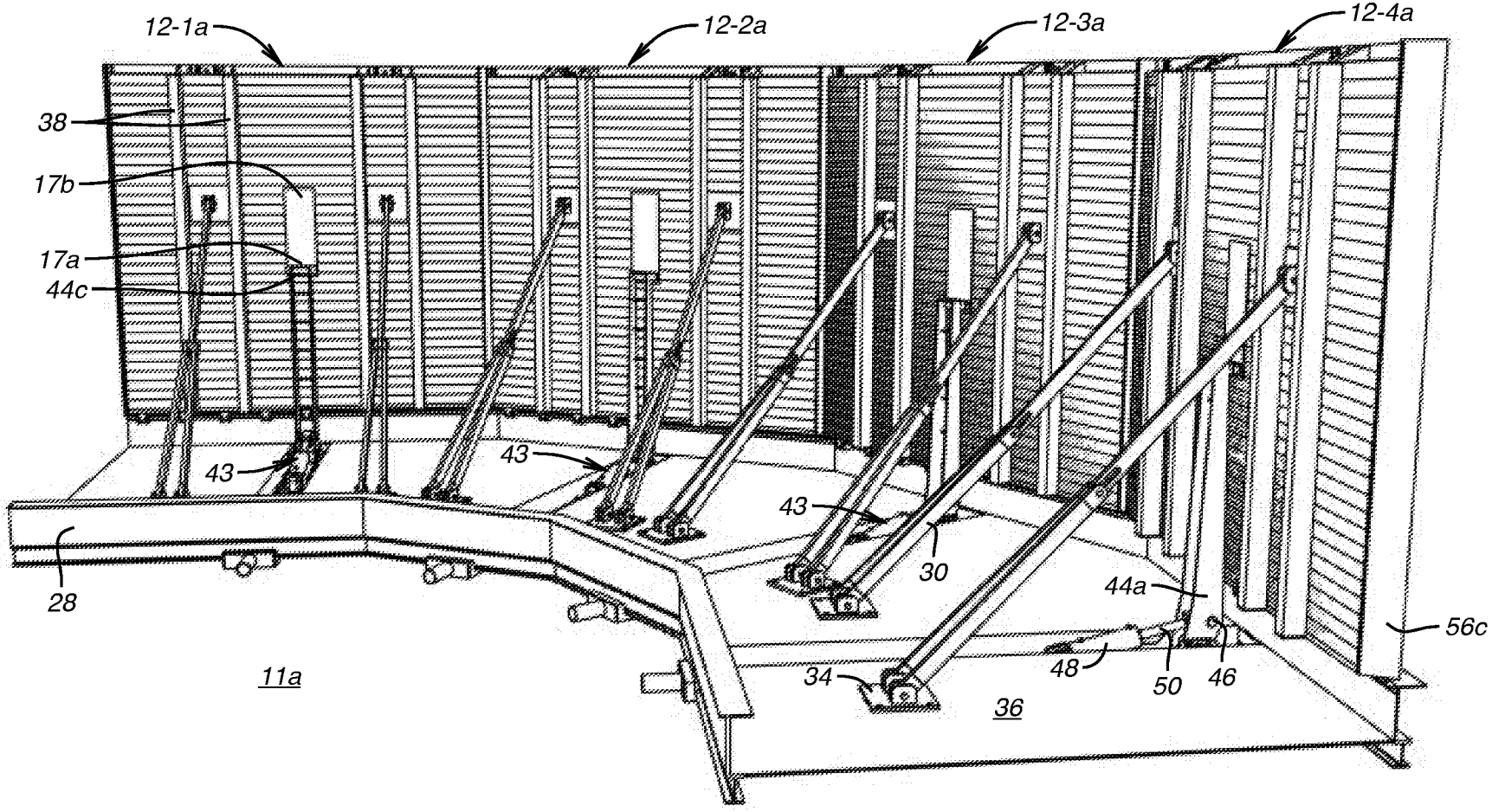

FIG. 27 is an isometric view of the panels of FIGS. 24-26 fully raised, viewed from the left end wet side of the flood barrier. FIG. 28 is an isometric view of the panels of FIG. 27 partially viewed from the left end dry side of the flood barrier. FIG. 29 is an isometric view of the panels of FIG. 28, viewed from the right end wet side of the flood barrier. The inside curve arrangement shown in FIGS. 24-29 extend in a 90 degree turn to the right but the arrangement can be an inside curve of lesser turn or an inside curve of greater turn, up to about 180 degrees, the radius of the turn depending on the site to be protected.

Figure 30:
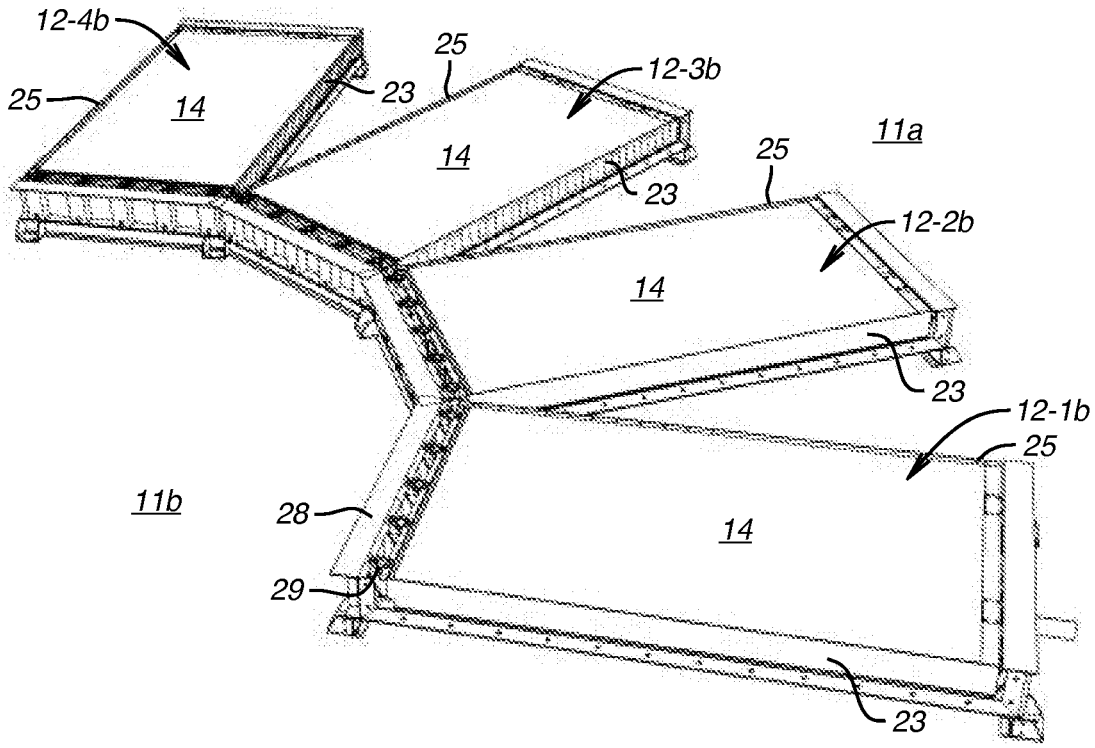
Figure 31:
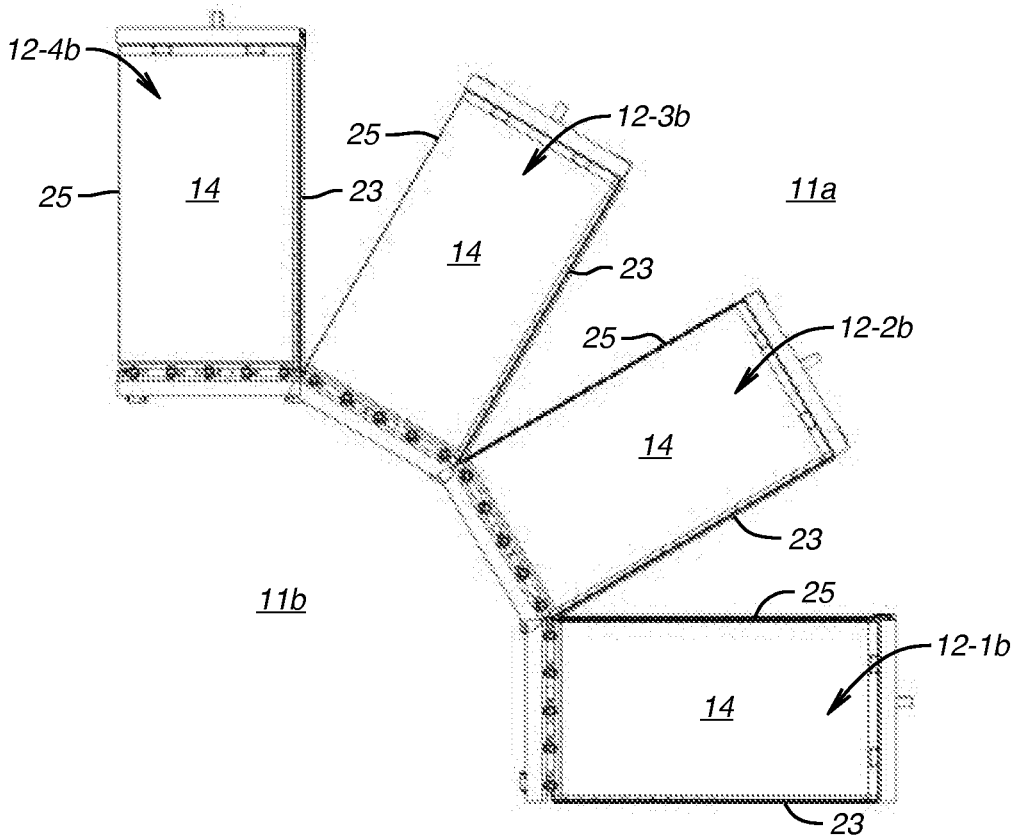
Figure 32:
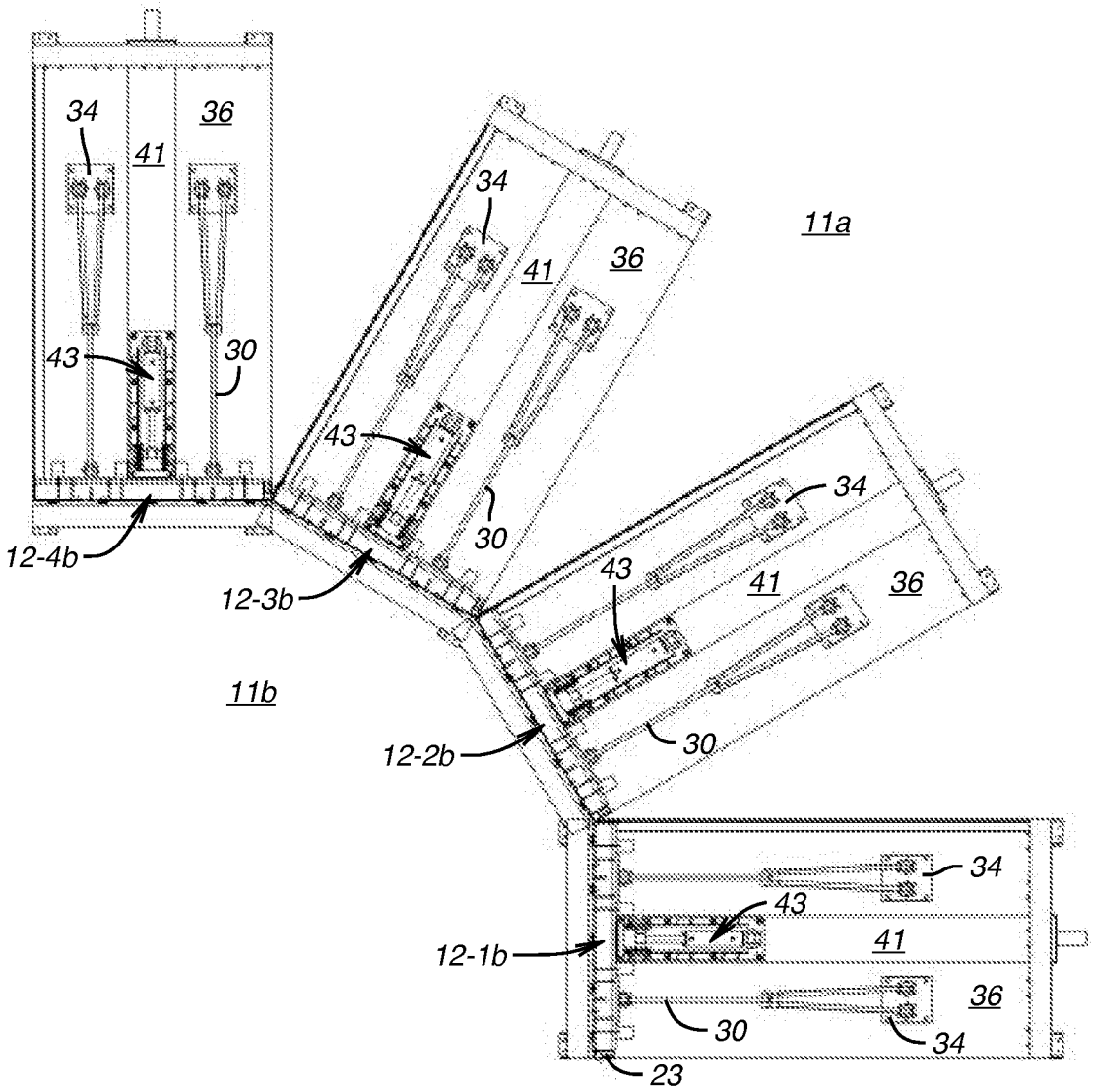

Turning now to FIGS. 30-37, exemplary embodiments of an arrangement of the assemblies in an outside curve for going around an outside corner are shown. FIG. 30 is a side perspective view of four housed panels 12-1*b*, 12-2*b*, 12-3*b* and 12-4*b* arranged in an outside curve. The support housings are separate pans 28 radially spread apart in a 90 degree turn to the left, splayed except for slight overlap at a lip at the base of the pans to the rear of the first axis of rotation 29. The center of the curve is to the left of the viewer on the dry side of the flood barrier. FIG. 31 is a top plan view of the housed panels of FIG. 30. Panels 12-1*b*, 12-2*b*, 12-3*b* and 12-4*b* are similar to panels 12-1*a*, 12-2*a*, 12-3*a* and 12-4*a* except panels 12-1*b*, 12-2*b*, 12-3*b* and 12-4*b* do not have an angled contact surface 56*c*. The contact surfaces in panels 12-1*b*, 12-2*b*, 12-3*b* and 12-4*b* are perpendicular to top surface 14 and are indicated by the reference numeral 56*b*. Contact surfaces 56*b* and gaskets 52*a* seen in FIG. 32 are better viewed in FIG. 36 with contact established. The suffix "b" added to the -1, -2, -3, -4 appendices to the reference numeral 12 to indicate the contact surface difference from panels 12-1*a*, 12-2*a*, 12-3*a* and 12-4*a*. Like the exemplary embodiments of FIGS. 1-9 and 24-29, the exemplary embodiments of FIGS. 30-37 are a "first configuration" type in which one panel has (a) a gasket attached to a panel lateral side that is next adjacent to the other panel, the gasket coursing the length of the panel lateral side and (b) a contact surface at the other lateral side of such panel than the lateral side to which said gasket is attached, the contact surface running the length of such other lateral side. The reference numerals for FIGS. 30-37 that are the same as in FIGS. 24-29 indicate the same structure as in the embodiments of FIGS. 24-29. Like the exemplary embodiments of FIGS. 24-29, the exemplary embodiments of FIGS. 30-37 raise in the order 12-1*b*, 12-2*b*, 12-3*b* and 12-4*b* one after the other. Panel 12-1*b* is first raised upright, presenting a right lateral side 25 contact surface 56*b*. Panel 12-2*b* is then raised fully upright, impressing gasket 52*a* in left lateral side 23 of panel 12-2*b* on contact surface 56*b* of right lateral side 25 of panel 12-1*b*, sealing the juncture between panel 12-1*b* and panel 12-2*b*, and so on though panels 12-2*b*, 12-3*b* and 12-4*b*.

Figure 33:
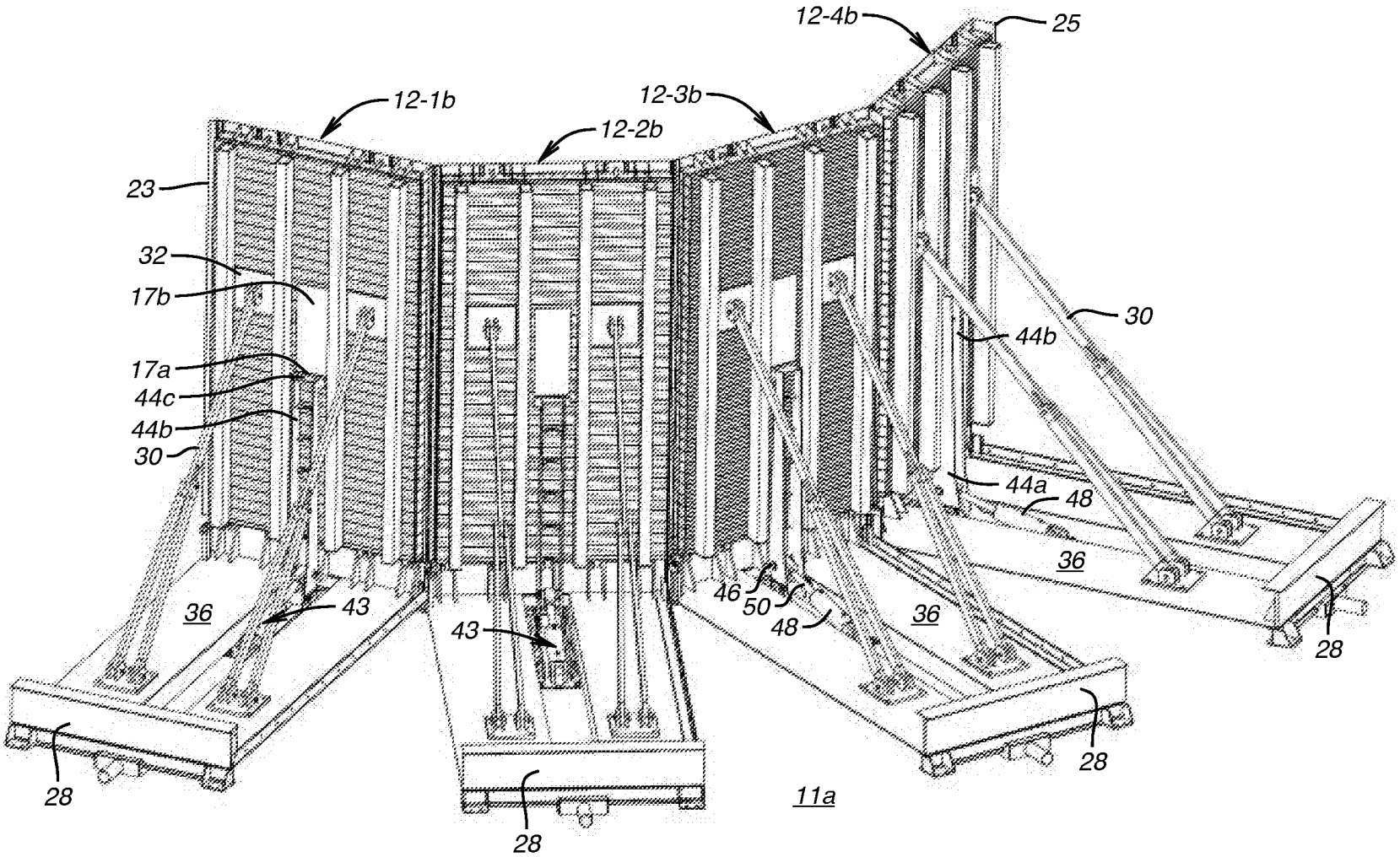
Figure 34:
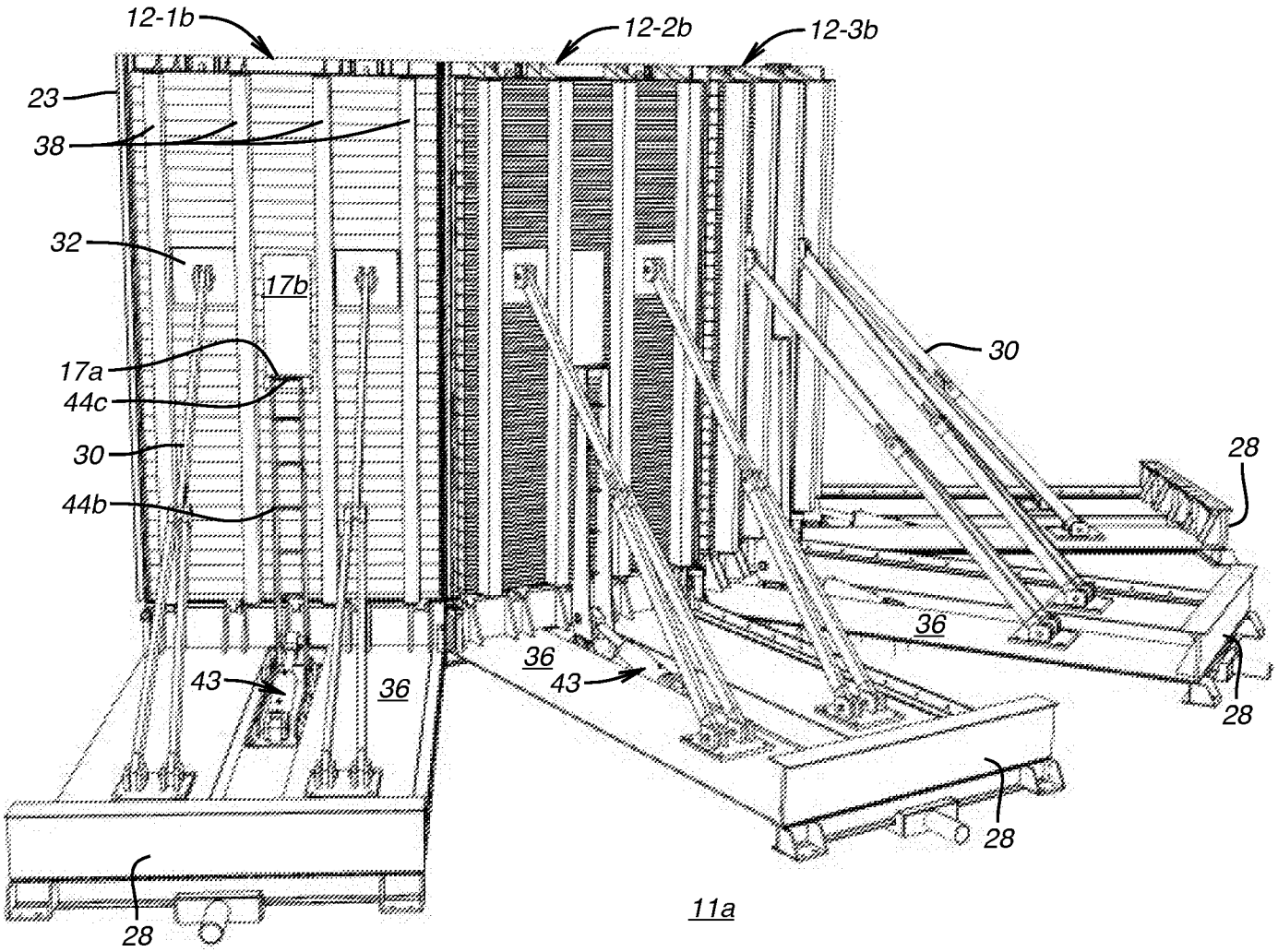
Figure 35:
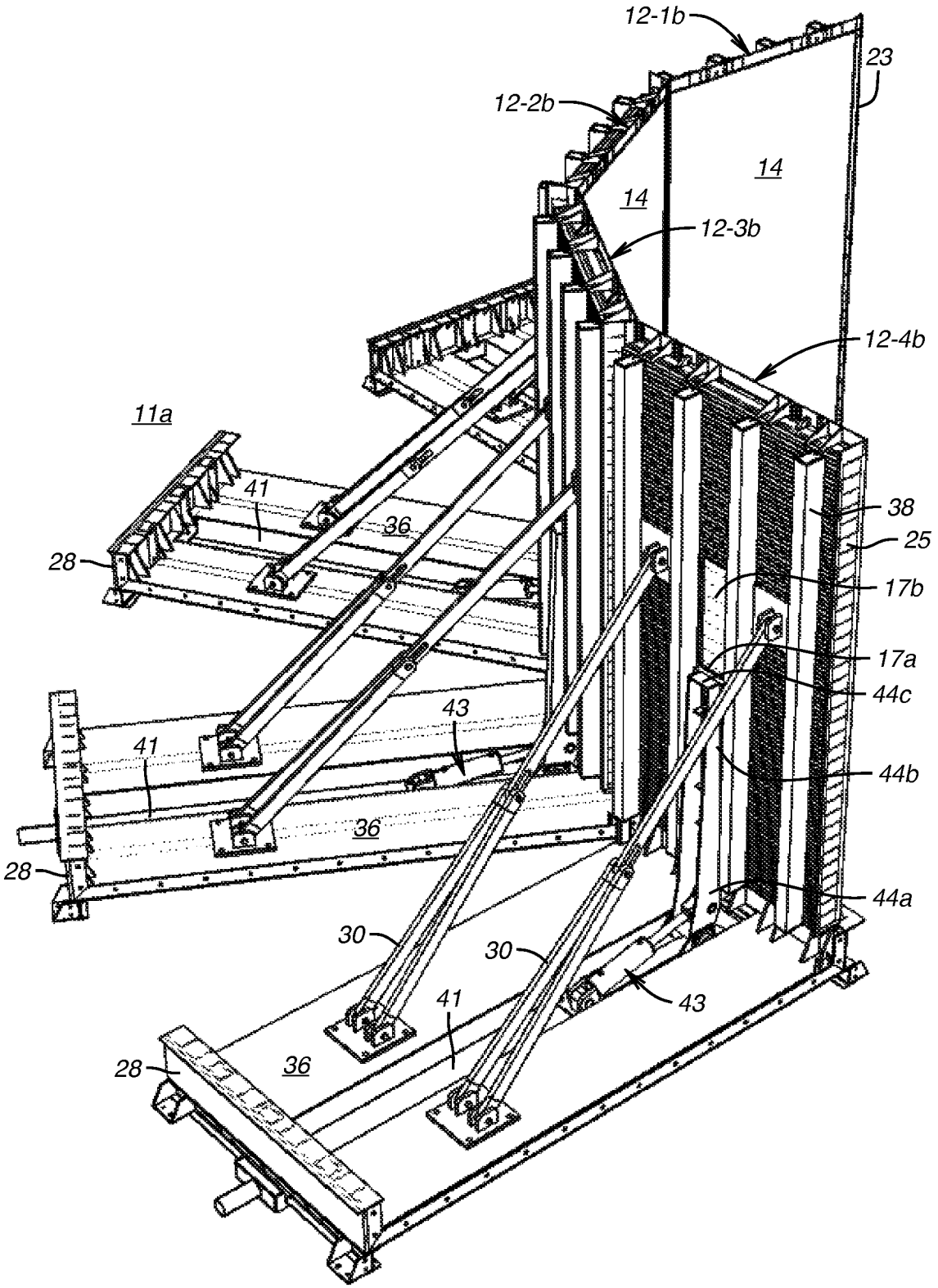
Figure 36:
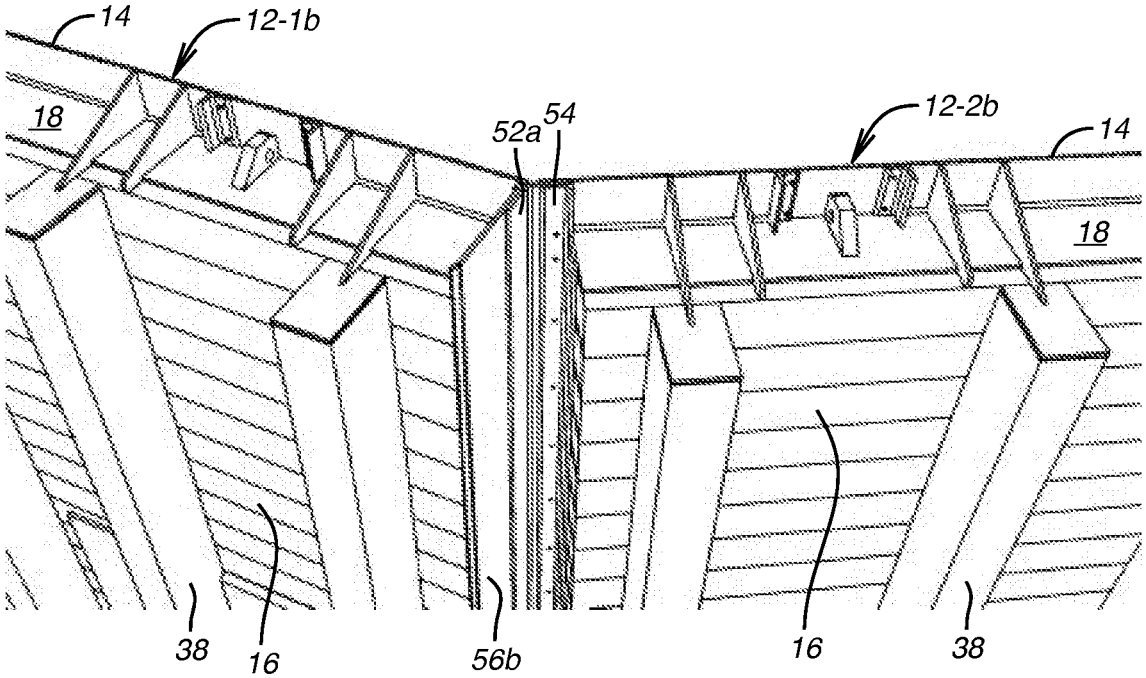
Figure 37:
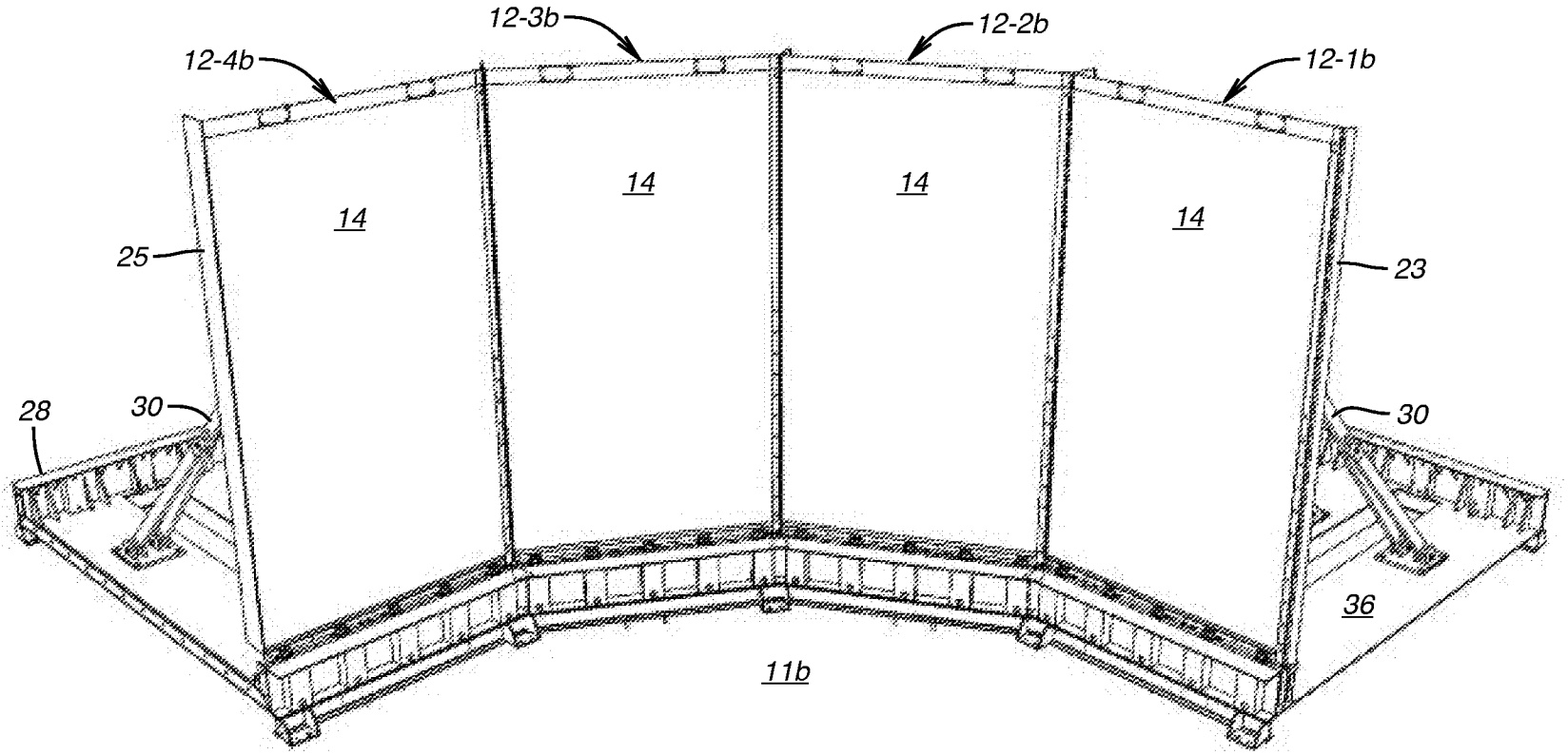

FIG. 32 is a top plan view of the raised panels housed in FIG. 30, showing the splayed spread of the housings as also seen on FIG. 31 for going around an outside corner or point of a shoreline. As in the instance of inside curve panels 12-1*a*, 12-2*a*, 12-3*a* and 12-4*a*, the embodiments are shown in a curve extending in a 90 degree turn, albeit in an outside curve, but the arrangement can be an outside curve of lesser turn or an outside curve of greater turn, up to about 180 degrees, the radius of the turn depending on the site to be protected FIG. 33 is an isometric view of the raised panels of FIG. 32, viewed from an intermediate wet side of the flood barrier. FIG. 34 is an isometric view of the raised panels of FIG. 32, viewed from the left end wet side of the flood barrier. FIG. 35 is an isometric view of the raised panels of FIG. 32, viewed from the right end wet side of the flood barrier. FIG. 36 is a partial perspective view showing the wiper seal closure of adjacent end panels of the panels of FIGS. 32-35. FIG. 37 is an isometric view of the raised panels of FIG. 36, viewed from the intermediate dry side of the flood barrier.

From the foregoing, it will be seen that the exemplary embodiments described provide an over-trafficking surface on land, erectable into a continuous barrier preventing flooding of the land. And it will have been seen that the top surface of the flood barrier assemblies always faces the dry side.

A method of operation comprises (a) providing on land 11, near a shoreline of water frontage, a plurality of flood barrier assemblies series 10 comprising at least one support pan 28 situated on the land beneath the surface of the land, and a plurality of next adjacent panels 12, each panel having a top surface 14, a bottom surface 16, a front end 18, a back end 20, and lateral sides 22, 24 at an imagined projected intersecting angle to the shoreline and of a length that runs from the back end 20 to at least near the front end 18 of panel 12, panel 12 residing lowered in the support pan 28, hingedly rotatable on a substantially horizontal first axis of rotation 29 at the back end 20 of the panel 12 to rotate upwardly from the pan 28 to an upright raised position where invading flood water will be contained behind the bottom surface 16 of the panel 12, the next adjacent panels 12 having either (i) a "first configuration" in which one panel 12 has (a) a gasket 52 attached to a panel lateral side 22 or 23 that is next adjacent to the next adjacent panel, the gasket 52 coursing the length of the panel lateral side 22 or 23 and (b) a contact surface 56 on the other lateral side 24 or 25 of such panel than the lateral side 22 or 23 to which the gasket 52 is attached, the contact surface 56 running the length of the other lateral side 24, or (ii) a "second configuration" in which a first panel (e.g. 12-3), separates two panels (e.g. 12-1 and 12-2) next adjacent to the first panel 12-3, the two panels 12-1 and 12-2 having a contact surface 56 on at least one lateral side 24 next adjacent the first panel 12-1, such contact surface 56 running the length of such lateral side 24, the first panel 12-3 having a gasket 52 attached on each of its lateral sides 22 running the length of the lateral side 22 to which such gasket 52 is attached, or (iii) a "third configuration "comprising a combination of one or more panels 12 of the first configuration and one or more panels 12 of the second configuration, and (b) raising the panels 12 from the substantially horizontal disposition to the upright position in a predetermined sequence, pressure of the gasket 52 against the contact surface 56 of the panels 12 resisting a hydrostatic force of water contained behind the bottom surface 16 of the panels 12 and providing a positive seal against water passing between the panels 12, the plurality of next adjacent panels 12 providing a continuous water barrier preventing flooding of the land 11*b* on the top surface 14 side of the panels 12 when raised to the upright position.

The foregoing method of operation may be one in which the panels 12 are raised from the pan to an upright position either (i) individually in a predetermined sequence or (ii) as contiguous groups of panels 13 in which adjacent panels 12 of a group 13 are raised all at the same time in a predetermined sequence, in either instance of (i) or (ii), in which a first panel 12 or a first group of panels 13 is raised to an upright position before a next adjacent second panel 12 or an next adjacent group of panels 13 is raised to an upright position, the raised first panel 12 or group of panels 13 presenting a contact surface 56 for contact of the gasket 52 of the second to rise next adjacent second panel 12 or next adjacent panel of the second to rise group of panels 13, hydrostatic pressure from water blocked behind the bottom surface 16 pressing the gasket 52 against the contact surface 56 of the first to rise panel 12 or of the group of panels 13, providing a positive seal against invading flood water passing between the panels. The predetermined sequence for panels 12 in the first configuration may be raising individual panels 12 or a group of panels 13 successively one after the other. The predetermined sequence for panels 12 in the second configuration may be raising at least two of the panels 12 having a contact surface 56 on at least one lateral side 24 before raising a next adjacent panel 12 having a gasket 52 attached on both lateral sides 22 to be between the at least two panels 12.

In accordance with the methods of operation, the panels 12 when raised upright may be linearly arrayed, or arrayed in a curve, or some the panels 12 when raised upright may be linearly arrayed and some the panels 12 when raised upright may be arrayed in a curve.

In a method of operation in which the panels 12 when upright are linearly arrayed, interior single or plural panels 12 of a group of panels 13 resident in a support pan 28 each have the gasket 52 contacting the contact surface 56 of the next adjacent panel 12. The panels may be raised from the support pan 28 to an upright position all at the same time, and hydrostatic pressure from water blocked behind the bottom surface 16 will press the gasket 52 against the contact surface 56 of the group of panels 13 to provide a positive seal against invading flood water passing between the panels 12 of the group 13.

The disclosed subject matter is to be considered illustrative, and not restrictive, and the appended claims are intended to cover all modifications, enhancements, and other embodiments that fall within the true scope of the present invention, which to the maximum extent allowed by law, is to be determined by the broadest permissible interpretation of the following claims and their equivalents, unrestricted or limited by the foregoing detailed descriptions of exemplary embodiments of the invention.

I claim:

1. Apparatus comprising a plurality of flood barrier assemblies arranged on land near a water frontage shoreline, each assembly comprising:

at least one substantially horizontal support situated in or on a surface of said land, a plurality of individually mechanically controllable laterally adjacent panels, each panel having a top surface, a bottom surface, a front end, a back end, and lateral sides at an imagined projected intersecting angle to said shoreline and of a length that runs from said back end to at least near the front end of the panel, the panel residing in or on said support in a lowered position, hingedly rotatable on a substantially horizontal first axis of rotation at said back end of the panel to rotate upwardly from said support to a raised position where invading flood water will be contained at said bottom surface of the panel, said adjacent panels having either (i) a first configuration in which one panel has (a) a gasket attached to a panel lateral side that is adjacent to the other panel, said gasket having a length coursing the length of said panel lateral side and (b) a contact surface at the other lateral side of such panel than the lateral side to which said gasket is attached, said contact surface running the length of said other lateral side, said other panel raising before said one panel for presentation of said contact surface to said gasket of a raising said one panel, said gasket of said raising one panel not completing a seal against said other panel until the entire length of said gasket is in contact with the contact surface of said other panel, or (ii) a second configuration in which a first panel separates two panels adjacent to the first panel, the two panels having a contact surface on at least one lateral side adjacent the first panel, such contact surface running the length of said lateral side, the first panel having a gasket attached on each of its lateral sides, said gasket having a length running the length of the lateral side to which such gasket is attached, said two panels raising before said first panel for presentation of said contact surfaces of said two panels to said gaskets of a raising said first panel, said gaskets of said raising first panel not completing a seal against said two panels until the entire length of said gaskets is in contact with the contact surfaces of said two panels, or (iii) a third configuration comprising a combination of one or more panels of said first configuration and one or more panels of said second configuration, hydrostatic pressure from invading flood water blocked at said bottom surface of said raised panels pressing said gasket of said one panel against the contact surface of said other panel in said first or third configuration or pressing said gaskets of said first panel against the contact surfaces of said two panels in said second or third configuration, providing a positive seal against water passing between said panels, said plurality of adjacent panels providing a continuous water barrier preventing flooding of the land beyond the front surface side of said panels when rotated to said raised position.

2. The apparatus of claim 1 further comprising an upright structure fixed to land adjacent each end of the plurality of adjacent panels and having a contact surface as tall as the panel adjacent to said upright structure when said adjacent panel is in an upright position, said lateral side of panel adjacent said upright structure attaching a gasket for sealing contact with said contact surface of said upright structure.

3. The apparatus of claim 1 in which at least one tensioning member is connected to said support and to the bottom surface of each panel, the tensioning members when loaded by hydrostatic pressure of water contained on the bottom side of raised said panels preventing the panels from rotating past an upright position.

4. The apparatus of claim 1 in which the top surface of each panel is substantially horizontally disposed relative to said surface of said land when said panel is in said lowered position in said support, providing an over-trafficking surface when in said support.

5. The apparatus of claim 4 in which said top surface of said panel is substantially flush with said surface of the land in which said support is situated.

6. The apparatus of claim 1 in which said contact surface at the lateral side of a panel comprises an extension from said top surface of said panel over said lateral side substantially coplanar to said top surface, or a lateral projection from said lateral side substantially parallel to said top surface.

7. The apparatus of claim 6 in which said gasket is a compression seal.

8. The apparatus of claim 1 in which said contact surface at the lateral side of a panel is said lateral side.

9. The apparatus of claim 8 in which said gasket is a wiping seal having a front wiping side and a pressure application back side.

10. The apparatus of claim 1 in which said panels are controllably mechanically sequentially raiseable from said support either (x) individually in a predetermined sequence or (y) as contiguous groups of panels in which adjacent said panels of a group are raised all at the same time in a predetermined sequence, in either instance of (x) or (y), in which at least one panel or a group of panels is raised before an adjacent panel or an adjacent group of panels is raised, the first raised at least one panel or first raised group of panels presenting said contact surface for contact of the gasket of the second to rise next adjacent panel or the next adjacent panel of said second to rise group of panels.

11. The apparatus of claim 10 in which said panels when raised are linearly arrayed.

12. The apparatus of claim 11 in which interior single or plural panels of said group of panels resident in said support each have said gasket contacting said contact surface of said adjacent panel.

13. The apparatus of claim 1 in which said contact surface on the lateral side of a panel is acutely angled to said top surface of said panel and in which said panels when raised are arrayed in an inside curve.

14. The apparatus of claim 1 in which said contact surface on the lateral side of a panel is obtusely angled to said top surface of said panel and in which said panels when raised are arrayed in an outside curve.

15. The apparatus of claim 13 in which said gasket is a wiping seal having a front wiping side and a pressure application back side.

16. The apparatus of claim 14 in which said gasket is a wiping seal having a front wiping side and a pressure application back side.

17. The apparatus of claim 1 in which some panels when raised are linearly arrayed and some panels when raised are arrayed in a curve.

18. The apparatus of claim 17 further comprising an upright structure fixed to land adjacent each end of the plurality of adjacent panels and having a contact surface as tall as the panel adjacent to said upright structure when said adjacent panel is in said upright position, said lateral side of panel adjacent said upright structure attaching a gasket for sealing contact with said contact surface of said upright structure.

19. The apparatus of claim 18 in which at least one tensioning member is connected to said support and to the bottom surface of each panel, the tensioning members when loaded by hydrostatic pressure of water contained on the bottom side of raised said panels preventing the panels from rotating past an upright position.

20. The apparatus of claim 1 in which said panels when raised are linearly arrayed and in which interior single or plural panels of a group of panels resident in said support each have said gasket contacting said contact surface of said adjacent panel and in which said group of panels are raiseable from said support all at the same time.

21. The apparatus of claim 20 further comprising an upright structure having a contact surface as tall as said panels in said upright position and fixed to land adjacent each end of the plurality of adjacent panels, said lateral side of end panels of said plurality of adjacent panels attaching a gasket for sealing contact with said contact surface of said upright structure.

22. The apparatus of claim 21 in which at least one tensioning member is connected to said support and to the bottom surface of each panel, the tensioning members when loaded by hydrostatic pressure of water contained on the bottom side of raised said panels preventing the panels from rotating past an upright position.

23. The apparatus of claim 1 comprising at least one panel raising mechanism for said panels supported on said support under said panels, either operatively associated with a single panel or with a group of said panels to raise a panel or a group of panels upwardly from said support.

24. The apparatus of claim 1 in which said mechanism for raising said panels or group of panels comprises:

a lift arm positioned under said panel normal to said first axis of rotation and pivotingly supported on said support for rotation from a lowered position upwardly about a substantially horizontal second axis of rotation that is parallel to said first axis of rotation, said lift arm having an aft portion and a fore portion, a powered driver fixed on said support, and a driven member connected proximately to said powered driver and distally to said aft portion of a lift arm, whereby on activation of said driver said aft portion is drawn forward and said fore portion is rotated upward on said second axis to lift said panel rotationally upwardly on said first axis to a raised position.

25. The apparatus of claim 24 in which fore portion of said lift arm is not connected to said bottom surface of said panel and in which the panels are buoyant passively responsive to a rise of water higher than a surface of said land in or on which said support is situated, to buoyantly rotate upwardly about said first axis.

26. A method comprising:

(a) providing on land, near a shoreline of water frontage, a plurality of flood barrier assembly series comprising:

at least one substantially horizontal support situated in or on a surface of said land, a plurality of individually mechanically controllable laterally adjacent panels, each panel having a top surface, a bottom surface, a front end, a back end, and lateral sides at an imagined projected intersecting angle to said shoreline and of a length that runs from said back end to at least near the front end of the panel, the panel residing lowered in or on said support, hingedly rotatable on a substantially horizontal first axis of rotation at said back end of the panel to rotate upwardly from said support to a raised position where invading flood water will be contained behind said bottom surface of the panel, said adjacent panels having either (i) a first configuration in which one panel has (a) a gasket attached to a panel lateral side that is adjacent to the other panel of the pair, said gasket having a length coursing the length of said panel lateral side and (b) a contact surface on the other lateral side of such panel than the lateral side to which said gasket is attached, said contact side running the length of said other lateral side, said other panel raising before said one panel for presentation of said contact surface to said gasket of a raising said one panel, said gasket of said raising one panel not completing a seal against said other panel until the entire length of said gasket is in contact with the contact surface of said other panel, or (ii) a second configuration in which a first panel separates two panels adjacent to the first panel, the two panels having a contact surface on at least one lateral side adjacent the first panel, such contact surface running the length of said lateral side, the first panel having a gasket attached on each of its lateral sides, said gasket having a length running the length of the lateral side to which such gasket is attached, said two panels raising before said first panel for presentation of said contact surface of said two panels to said gaskets of a raising said first panel, said gaskets of said raising first panel not completing a seal against said two panels until the entire length of said gaskets is in contact with the contact surfaces of said two panels, or (iii) a third configuration comprising a combination of one or more panels of said first configuration and one or more panels of said second configuration, and (b) controllably mechanically raising said panels from said substantially horizontal disposition, pressure of the gasket against the contact surface of the panels resisting a hydrostatic force of water contained behind said bottom surface of the panels and providing a positive seal against water passing between said panels, said plurality of adjacent panels providing a continuous water barrier preventing flooding of the land beyond the top surface side of said panels when raised.

27. The method of claim 26 in which said panels are controllably mechanically raised from said support either (i) individually in a predetermined sequence or (ii) as contiguous groups of panels in which adjacent said panels of a group are raised all at the same time in a predetermined sequence, in either instance of (i) or (ii), in which at least one panel or a group of panels is raised before an adjacent panel or an adjacent group of panels is raised.

28. The method of claim 27 in which the predetermined sequence for panels in said first configuration is raising individual panels or said group of panels successively one after the other.

29. The method of claim 27 in which the predetermined sequence for panels in said second configuration is raising said two panels having a contact surface on at least one lateral side adjacent said first panel before raising said first panel having a gasket attached on both lateral sides.

30. The method of claim 26 in which said panels when raised are linearly arrayed.

31. The method of claim 26 in which said contact surface on the lateral side of a panel is acutely angled to said top surface of said panel and in which said panels when raised are arrayed in an inside curve.

32. The method of claim 26 in which some said panels when raised are linearly arrayed and some said panels when raised are arrayed in a curve.

33. The method of claim 26 in which said panels when raised are linearly arrayed and in which interior single or plural panels of a group of panels resident in said support each have said gasket contacting said contact surface of said adjacent panel and in which said group of panels are raised from said support all at the same time.

34. The method of claim 26 in which said contact surface on the lateral side of a panel is obtusely angled to said top surface of said panel and in which said panels when raised are arrayed in an outside curve.

* * * * *